US012104887B2

(12) United States Patent
Johnson et al.

(10) Patent No.: US 12,104,887 B2
(45) Date of Patent: Oct. 1, 2024

(54) EXPLOSIVE DEVICE CONFIGURED FOR PRODUCING A QUASI-PLANAR SHOCK WAVE

(71) Applicant: Orica International Pte Ltd, Singapore (SG)

(72) Inventors: David Olaf Johnson, Aurora, CO (US); Dale S. Preece, Saratoga Springs, UT (US); Matthew Tolliver Rawls, Watkins, CO (US); Chad D. Chaffin, Aurora, CO (US); Ayman Tawadrous, Aurora, CO (US)

(73) Assignee: Orica International Pte Ltd, Singapore (SG)

( * ) Notice: Subject to any disclaimer, the term of this patent is extended or adjusted under 35 U.S.C. 154(b) by 231 days.

(21) Appl. No.: 17/250,510

(22) PCT Filed: Jul. 31, 2019

(86) PCT No.: PCT/SG2019/050383
§ 371 (c)(1),
(2) Date: Jan. 29, 2021

(87) PCT Pub. No.: WO2020/027736
PCT Pub. Date: Feb. 6, 2020

(65) Prior Publication Data

US 2021/0310773 A1 Oct. 7, 2021

Related U.S. Application Data

(60) Provisional application No. 62/712,935, filed on Jul. 31, 2018.

(51) Int. Cl.
*F42B 1/02* (2006.01)
*F42B 3/08* (2006.01)
(Continued)

(52) U.S. Cl.
CPC ..... *F42B 3/22* (2013.01); *F42B 1/02* (2013.01); *F42B 3/08* (2013.01); *F42B 1/028* (2013.01)

(58) Field of Classification Search
CPC .. F42B 1/02; F42B 1/024; F42B 1/028; F42B 1/036; F42B 3/22; F42B 3/00; F42B 3/08
(Continued)

(56) References Cited

U.S. PATENT DOCUMENTS 342,423 A 5/1886 Bloem
3,034,393 A 5/1962 Lieberman
(Continued)

FOREIGN PATENT DOCUMENTS

GB 2595699 A * 12/2021 ..... E21B 43/117
RU 2540759 C1 2/2015
WO WO-2024083703 A1 * 4/2024 ..... F42B 1/02

OTHER PUBLICATIONS

International Search Report and Written Opinion of International Searching Authority for Application No. PCT/SG2019/050383, mailed Oct. 17, 2019 (13 pages).
(Continued)

*Primary Examiner* — James S Bergin
(74) *Attorney, Agent, or Firm* — Nixon Peabody LLP

(57) ABSTRACT

An explosive device configured for outputting a quasi-planar shock wave includes: a body structure having a proximal end and an opposing distal end, and within which (a) an initiation device chamber; (b) a donor charge having a geometric shape correlated with first cone having an internal void exhibiting a geometric shape correlated with a second cone, wherein a first base of the first cone and a second base of the second cone reside in a common plane and have a common center point; (c) a non-explosive wave shaper filling the void; and (d) an acceptor charge are sequentially
(Continued)

disposed adjacent to each other in a direction toward the distal end. Perpendicular to the central axis, a maximum lateral span of each of the wave shaper, the donor charge, and the acceptor charge coincide. The acceptor explosive charge mass does not laterally extend to a set of body structure outer walls.

15 Claims, 14 Drawing Sheets

(51) Int. Cl.
*F42B 3/22* (2006.01)
*F42B 1/028* (2006.01)

(58) Field of Classification Search
USPC ..... 102/305–307, 309
See application file for complete search history.

(56) References Cited

U.S. PATENT DOCUMENTS 3,451,339 A 6/1969 Precoul
3,658,007 A * 4/1972 Bucklisch ..... F42B 1/024 102/306
3,662,684 A * 5/1972 Bodinaux ..... F42B 1/024 102/476
3,924,510 A 12/1975 Strunk
4,672,896 A * 6/1987 Precoul ..... F42B 1/028 102/476
4,896,609 A * 1/1990 Betts ..... F42B 1/02 102/505
10,036,610 B2 7/2018 Rivera
10,036,616 B2 * 7/2018 Gash ..... F42B 1/02
2010/0294156 A1 11/2010 Berlin
2017/0227340 A1 8/2017 Van Niekerk
2022/0236433 A1 * 7/2022 Petrovic ..... G01S 19/01

OTHER PUBLICATIONS

Fritz; "A Simple Plane-Wave Explosive Lens"; Los Alamos National Laboratories Publication LA-11956-MS, UC-706 and UC-741; Dec. 1990; DOI: 10.2172/6430373 (24 pages).
Eccles, P.; "An Introduction to Mathematical Reasoning: Numbers, Sets, and Functions; Chapter 11: Properties of Finite Sets"; Cambridge University Press; 1998 (9 pages).
Al'tshuler, L. V. et al.; "Development of dynamic high-pressure techniques in Russia"; Physics-Uspekhi 42 (3), pp. 261-280; Uspekhi Fizicheskikh Nauk, Russian Academy of Sciences; Mar. 1999 (20 pages).
Austin, C.; "Lined-Cavity Shaped Charges and Their Use in Rock and Earth Materials"; State Bureau of Mines and Mineral Resources, New Mexico Institute of Mining & Technology, Campus Station, Socorro, New Mexico; Bulletin 69, 1959; (86 pages).
Chun-Yu Chen et al.; "Design of an Inert Material Type Plane Wave Generator"; Propellants, Explosives, Pyrotechnics, vol. 18, pp. 139-145; 1993; 0721-3115/93/0306-0139 (7 pages).
Cruise, J. A.; "The Development of a Directional Primer Charge for Blasting in Mines"; Doctorate thesis; University of Witwatersrand, Johannesburg 2005 (524 pages).
Wei Xiong et al.; "Study of simple plane wave generator with an air-metal barrier"; Defence Technology, vol. 10, pp. 190-197; http://dx.doi.org/10.1016/j.dt.2014.05.012; Jun. 11, 2014 (8 pages).

* cited by examiner (1)

(2)

330g (1)

(2)

110g

EXPLOSIVE DEVICE CONFIGURED FOR PRODUCING A QUASI-PLANAR SHOCK WAVE

RELATED APPLICATIONS

The present application is a U.S. National Stage of International Application No. PCT/SG2019/050383, filed on Jul. 31, 2019, which claims the benefit of U.S. Provisional Patent Application No. 62/712,935, filed on Jul. 31, 2018, each of which is hereby incorporated by reference in its entirety.

TECHNICAL FIELD

Aspects of present disclosure relate to an explosive device and method for blasting, and to a method of manufacturing the device. The explosive device may be configured for producing or outputting a substantially quasi-planar explosive wave front, e.g., a quasi-planar detonation front, across portions of a distal end of its body.

BACKGROUND

Blasting has a number of important commercial, industrial, or civil uses, including commercial blasting applications associated with mining, quarrying, and civil tunnelling, in which a substrate such as rock is fractured and/or displaced to facilitate substrate excavation, removal, and processing. Blasting also has several other important commercial applications. For instance, blasting can be used to generate seismic signals for resource exploration, and for civil demolition. The propagation of seismic source signals, the reflection of the seismic source signals off sub-surface features, the subsequent detection of these reflected seismic signals, and the computer-based analysis and/or imaging of such detected signals allows operators to infer the structure of substrata and the location or position of valuable resources (e.g., hydrocarbon reservoirs) relative thereto.

Conventionally, blasting involves controlled explosions using housings or shells containing explosive charges that are initiated below the surface of the earth. More particularly, in conventional blasting operations, prior to the initiation of explosive charges, the shells containing the explosive charges are positioned below the surface of the earth. The placement of explosive charges below the earth's surface means that in a typical blasting operation, an array of blastholes or boreholes must first be drilled into the earth to an undesirably large depth (e.g., to a depth of 5-100 metres) using special-purpose drilling equipment (e.g., a conventional drill rig), after which the explosive charges are positioned in the blastholes. With respect to conventional blasting-based seismic exploration, drilling an array of undesirably deep blastholes is time consuming and costly. Additionally, conventional drilling equipment is larger/more massive and consumes more energy than desired with respect to ease and speed of transport, deployment, powering, and use in highly remote and/or mountainous areas, such as wilderness areas. Moreover, the environmental impact associated with the use of conventional drilling equipment in wilderness areas is undesirably high. Thus, conventional blasting-based seismic exploration in such areas can be particularly time consuming, cumbersome, energy intensive, expensive, and/or environmentally unfriendly.

Conventional explosive devices commonly have a uniform or generally uniform cylindrically shaped explosive charge therein, although explosive devices having a uniform or generally uniform spherically shaped explosive charge therein have been developed. In general, an explosive charge is initiated by an initiating device or initiator that is placed in the shell which carries the explosive charge. The initiating device has integral transmission wires/leads attached, or alternatively wireless communication circuitry, to allow remote initiation of the explosive charge from the surface. The initiating device is typically placed in a central cavity of the shell in which the explosive charge resides. This placement results in central initiation of the explosive charge, and the generation of a shock wave that propagates in a substantially outward direction from the central initiation site.

Because of the shape of the explosive charge in a conventional explosive device, the spatial profile or distribution of the explosive or blast energy traveling away from the central initiation site into regions just beyond the periphery of the shell is substantially spherical, hemispherical, or teardrop shaped. Unfortunately, for common reflection seismic exploration applications such as vertical seismic profiling, this type of explosive energy spatial distribution fails to efficiently or preferentially couple explosive energy toward or into a target region of the earth because an undesirably or excessively large fraction of the explosive energy output by the explosive device travels in directions away from rather than toward the target region of the earth.

Other less common types of explosive devices have an explosive charge design by which explosive energy is highly focused to perform work for a number of specific functions, including penetrating natural and man-made structures (e.g., wellbores), or cutting and forming metal. Such explosive devices are generally referred to as shaped charges, and function through the generation of a high-speed, narrow diameter, tightly focused jet of blast energy that emanates from the explosive charge as a result of the incorporation of a cavity or spatial void in the explosive charge design. This cavity can be lined with metal or unlined, e.g., formed of the same material as other parts of the explosive charge housing. This jetting phenomenon is known as the Munroe (or shaped-charge) effect, and has been known for over a century, with patent activity dating back to 1886 as evidenced by U.S. Pat. No. 342,423.

A shaped charge is typically designed such that its explosive energy focusing delivers explosive energy across a small or very small cross-sectional area. This can be highly destructive to a target into which the shaped charge delivers its tightly focused explosive energy. Consequently, the development of shaped charges has been primarily driven by military applications requiring the penetration of, for example, armour. Conventional shaped charges are well suited for use in several types of commercial or civilian applications, such as wellbore casing perforation, but may be unsuitable for various other applications due to the aforementioned jetting phenomenon.

Certain types of explosive devices, conventionally referred to as plane wave generators or plane wave explosive lenses, have been designed to output explosive energy at a principal device output end in the form of a shock wave that is significantly more planar than hemispherical. For instance, U.S. Pat. No. 10,036,616 (U.S. Ser. No. 10/036,616) discloses such an explosive device, which is fabricated by way of three dimensional (3D) printing, and which typically consists of a first explosive material having a recess therein, e.g., a cylindrical first explosive material having a conical recess therein; and a second explosive material that precisely fits into and directly abuts the recess in the first explosive material, e.g., a conical second explosive material. Unfortunately, the plane wave generators disclosed in U.S. Ser. No. 10/036,616 are structured in a manner that undesirably limits the extent of shock wave planarity, and/or which releases an undesirably large amount of explosive energy in radial directions away from their principal output ends. Also, such devices are not well suited for low or very low cost, high or very high volume, rapid or very rapid mass production. Furthermore, such devices require that the first explosive material has a higher velocity of detonation (VoD) than the second explosive material, which renders such devices needlessly complex, and limits explosive device design, manufacturing, and performance flexibility.

Another plane wave generator device is disclosed by Fritz in A Simple Plane-Wave Explosive Lens, Los Alamos National Laboratories Publication LA-11956-MS, UC-706 and UC-741, December 1990, DOI: 10.2172/6430373. The explosive device structure disclosed by Fritz can exhibit an undesirable or significant amount of shock wave non-uniformity and/or non-planarity across its principal output end, and is not suitably structured for flexible in-field deployment.

In view of the foregoing, it may be advantageous to provide a plane wave generator type of explosive device having utility analogous to that of a conventional shell suitable for various commercial blasting operations, and which generates or outputs explosive energy in a manner that enhances or optimizes the efficiency of explosive energy coupling toward or into a particular or preferential target region of the earth, and which provides multiple features that facilitate more straightforward, time efficient, versatile, flexible, and/or environmentally friendly in-field deployment and/or use.

It is desired to address one or more limitations or shortcomings in the prior art, or to at least provide a useful alternative.

SUMMARY

Aspects of present disclosure relate to an explosive device having a body that internally carries a first or donor explosive charge mass; a non-explosive wave shaper; and a predetermined, selectable, or customized/customizable/changeable second, receptor, or acceptor explosive charge mass.

An explosive device in accordance with embodiments of the present disclosure is specifically or intentionally configured for producing or outputting explosive energy having a quasi-planar wave front across at least portions of a primary output end or distal end thereof, e.g., a wave front that is significantly less parabolic than that produced or output across a terminal end of a standard or conventional cylindrical booster. In various embodiments, an explosive device is specifically or intentionally configured for releasing at least approximately 8-30%, e.g., at least approximately 10-25%, of its stored chemical energy at its principal output end or distal end. Explosive devices in accordance with embodiments of the present disclosure have utility in at least: seismic applications directed to propagating explosive energy as a seismic wave into geomaterials as part of seismic exploration activities, e.g., vertical seismic profiling performed at the earth's surface; and mining-related applications directed to propagating explosive energy into environments, substrates, or materials external to the explosive device, e.g., into ammonium nitrate containing or ammonium nitrate based blasting agents for the initiation thereof.

In accordance with an aspect of the present disclosure, an explosive device includes: a body structure having a proximal end, an opposing distal end, a set of outer walls between its proximal end and distal end, a height along the set of outer walls, and a central axis extending along its height, wherein the central axis extends through a centroid or center point of the body structure's proximal end and a centroid or center point of the body structure's distal end; a slot or chamber formed within the body structure and configured for carrying a portion of an explosive initiation device; a donor explosive charge mass residing within the body structure, which has an upper end disposed proximate or adjacent to or in contact with a portion of the initiation device slot or chamber, and which downwardly extends toward the distal end of the body structure, wherein portions of the donor explosive charge mass exhibit a geometric shape that is correlated with or which corresponds to a first cone having a void formed therein, wherein the void exhibits a geometric shape that is correlated with or which corresponds to a second cone, and wherein a first base of the first cone and a smaller second base of the second cone reside in a common plane and share a common center point through which the body structure's central axis extends; and a non-explosive wave shaper residing within the body structure, and which occupies or fills the void.

In various embodiments, further comprising an acceptor explosive charge mass that downwardly extends away from the wave shaper toward the distal end of the body structure, optionally wherein the donor explosive charge mass, the wave shaper, and the acceptor explosive charge mass are cooperatively aligned relative to each other such that a maximum lateral span of the wave shaper perpendicular to the body structure's central axis coincides with each of a maximum lateral span of the donor explosive charge mass perpendicular to the central axis and a maximum lateral span of the acceptor explosive charge mass perpendicular to the central axis, and wherein the acceptor explosive charge mass does not laterally extend to the body structure's set of outer walls, and optionally wherein the wave shaper is disposed directly adjacent to the donor explosive charge mass, and the acceptor charge explosive mass is disposed directly adjacent to the wave shaper.

In multiple embodiments, the donor charge explosive mass exhibits a geometric shape that is correlated with or which corresponds to a right circular frustum of material, such that the upper end of the donor charge explosive mass corresponds to an upper base of the frustum of material, and a lowest end of the donor charge explosive mass corresponds to a lower base of the frustum of material.

The first cone is typically vertically truncated about the body structure's central axis at a predetermined radial distance away from the central axis.

In various embodiments, the acceptor charge explosive mass exhibits a geometric shape that is correlated with or which corresponds to a cylinder.

The body structure can exhibit a tapered geometric shape providing an upper tapered region across which the body structure narrows in a direction toward its proximal end.

In several embodiments, the donor explosive charge mass resides within an upper internal cavity formed within the body structure, the acceptor explosive charge mass resides within a lower internal cavity formed within the body structure, the upper internal cavity and the lower internal cavity are separated from each other by the wave shaper, and the wave shaper includes a set of channels formed therein that fluidically couples the upper internal chamber to the lower internal chamber.

The body structure can be a unitary structure; or alternatively, the body structure is a non-unitary structure that includes (i) an upper piece that carries the donor explosive charge mass and the wave shaper, and (ii) at least a first lower piece that is selectively couplable to the upper piece, and which carries the acceptor explosive charge mass.

The first lower piece and the upper piece can each carry counterpart snap-fit engagement structures or screw-type engagement structures by which they are couplable together.

The first lower piece can be selectively couplable to a second lower piece that carries an additional acceptor charge. The first lower piece and the second lower piece can each carry counterpart snap-fit engagement structures or screw-type engagement structures by which they are couplable together.

The acceptor charge and the additional acceptor charge can be different with respect to acceptor charge thickness, net explosive mass, explosive composition, and/or energy release properties.

In various embodiments, the wave shaper exhibits a vertical cross sectional area parallel to the central axis that geometrically corresponds to or is correlated with a triangle having an apex, and an apex angle of the triangle is between 37.5-43.3 degrees.

In various embodiments, a net explosive mass provided by the explosive device is between 50-330 g.

In accordance with an aspect of the present disclosure, an explosive device includes: (a) a body structure having a proximal end at an upper region thereof, an opposing distal end at a lower region thereof, a set of outer walls between its proximal end and distal end, a height along the set of outer walls, and a central axis extending along its height, wherein the central axis extends through a centroid or center point of the body structure's proximal end and a centroid or center point of the body structure's distal end, wherein the body structure includes an upper piece and at least a first lower piece, wherein the first lower piece is selectively couplable to the body structure; (b) a slot or chamber disposed the body structure and configured for carrying a portion of an explosive initiation device; (c) a donor explosive charge mass residing within the body structure, which has an upper end disposed proximate or adjacent to or in contact with a portion of the initiation device slot or chamber, and which downwardly extends toward the distal end of the body structure; (d) a non-explosive wave shaper residing within the body structure, which resides directly adjacent to the donor explosive charge mass and which extends downwardly toward the body structure's distal end; and (e) an acceptor explosive charge mass that downwardly extends away from the wave shaper toward the distal end of the body structure, wherein the upper piece of the body structure carries the slot or chamber and the donor charge explosive mass, and wherein the first lower piece carries the acceptor explosive charge mass.

In several embodiments, the upper piece of the body structure carries the wave shaper; however, in certain embodiments the lower piece of the body structure carries the wave shaper.

The upper piece of the body structure and the lower piece of the body structure typically carry counterpart engagement structures by which they are selectively couplable together.

In some embodiments, the explosive device further includes a second lower piece that is selectively couplable to at least one of the upper piece and the first lower piece. The first lower piece and the second lower piece can carry counterpart engagement structures by which the first lower piece and the second lower piece are couplable together.

In accordance with an aspect of the present disclosure, a method of blasting includes: generating a hemispherical shock wave in a donor explosive charge mass; receiving the hemispherical shock wave at a conical face of non-explosive wave shaper; reshaping a spatial profile of the hemispherical shock wave in the wave shaper; and outputting a transformed shock wave having a wave front that exhibits a non-hemispherical, quasi-planar spatial profile.

In accordance with an aspect of the present disclosure, a method of blasting includes: manually coupling an upper piece and at least a first lower piece of a body structure of an explosive device together; inserting an explosive initiation device into the upper piece; initiating the initiation device to initiate a donor explosive charge mass in the upper piece; propagating a hemispherical shock wave from the donor explosive charge mass to a non-explosive wave shaper; forming the hemispherical shock wave into a quasi-planar shock wave in the wave shaper; and propagating the quasi-planar shock wave from the wave shaper to an acceptor explosive charge mass in the first lower piece.

In accordance with an aspect of the present disclosure, a method of manufacturing the device above includes: forming the donor charge and the acceptor charge by way of a single temporally overlapping manufacturing process portion, using one or more internal channels in the body structure; or forming the donor charge and the acceptor charge in separate non-temporally overlapping manufacturing process portions.

BRIEF DESCRIPTION OF THE DRAWINGS

Embodiments of the present invention are hereinafter further described by way of example only with reference to the accompanying drawings in which.

DETAILED DESCRIPTION

Figure 1:
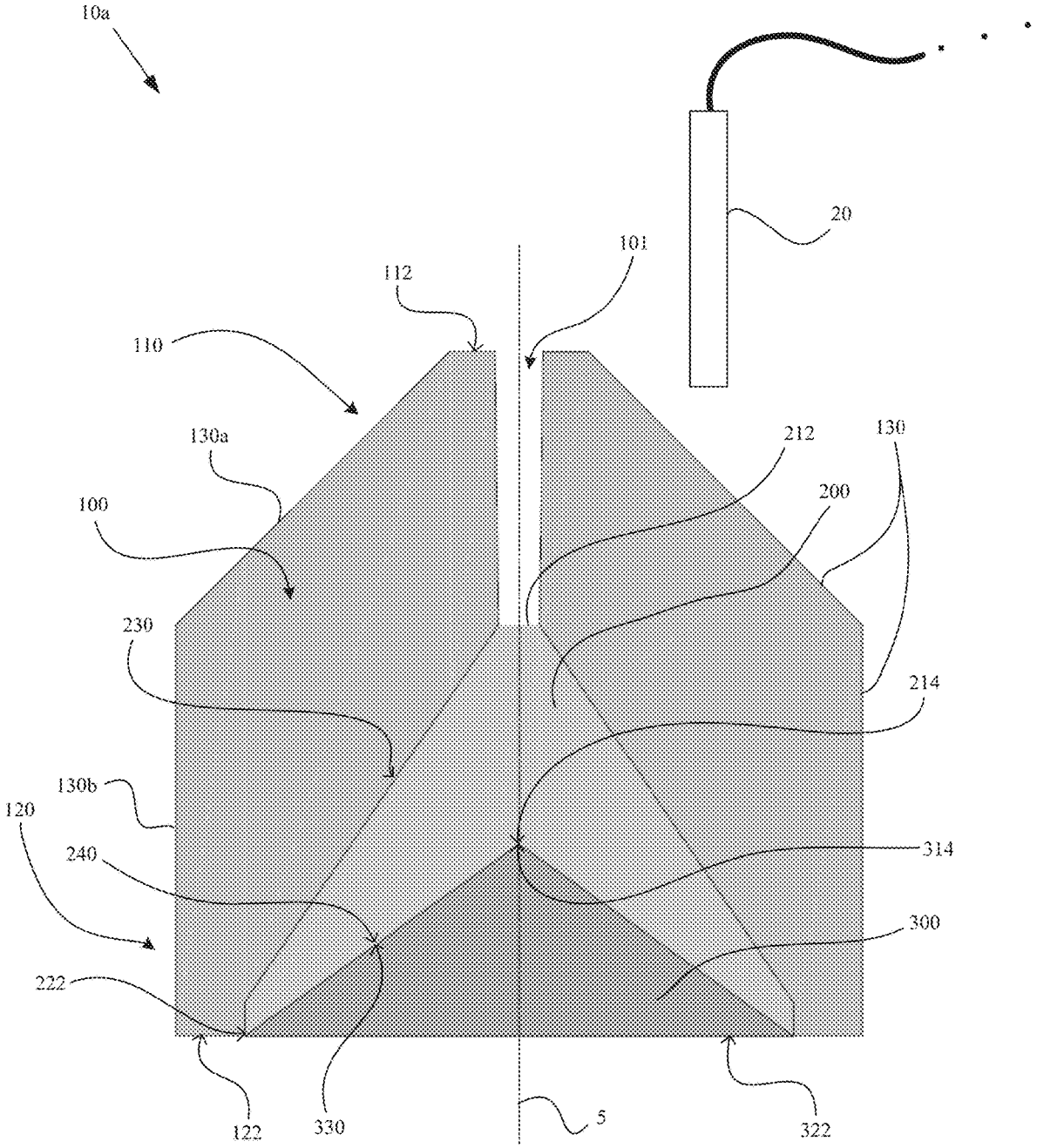
FIG. 1 is cross-sectional schematic illustration of an explosive device in accordance with an embodiment of the present disclosure, in which the explosive device includes a body structure within which a donor charge and a wave shaper reside, and the explosive does not include an acceptor charge.

Throughout this specification, unless the context stipulates or requires otherwise, any use of word "comprise", and variations such as "comprises" and "comprising", imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that prior publication (or information derived from it) or known matter forms part of the common general knowledge in the field of endeavor to which this specification relates.

The FIGS. included herewith show aspects of non-limiting representative embodiments in accordance with the present disclosure, and particular structural elements shown in the FIGS. may not be to scale or precisely to scale relative to each other. The depiction of a given element or consideration or use of a particular element number in a particular FIG. or a reference thereto in corresponding descriptive material can encompass the same, an equivalent, or an analogous element or element number identified in another FIG. or descriptive material associated therewith. The presence of "/" in a FIG. or text herein is understood to mean "and/or" unless otherwise indicated. The recitation of a particular numerical value or value range herein is understood to include or be a recitation of an approximate numerical value or value range, for instance, within +/−20%, +/−15%, +/−10%, +/−5%, +/−2.5%, +/−2%, +/−1%, +/−0.5%, or +/−0%. The term "essentially all" can indicate a percentage greater than or equal to 90%, for instance, 92.5%, 95%, 97.5%, 99%, or 100%.

As used herein, the term "set" corresponds to or is defined as a non-empty finite organization of elements that mathematically exhibits a cardinality of at least 1 (i.e., a set as defined herein can correspond to a unit, singlet, or single element set, or a multiple element set), in accordance with known mathematical definitions (for instance, in a manner corresponding to that described in An introduction to Mathematical Reasoning: Numbers, Sets, and Functions, "Chapter 11: Properties of Finite Sets" (e.g., as indicated on p. 140), by Peter J. Eccles, Cambridge University Press (1998)). Thus, a set includes at least one element. In general, an element of a set can include or be one or more portions of a system, an apparatus, a device, a structure, an object, a process, a physical parameter, or a value depending upon the type of set under consideration.

An initiable, explosive, explodable, or detonable device in accordance with various embodiments of the present disclosure includes a body structure that internally carries or confines (a) a set of explosive charge masses (hereafter "explosive charges" for purpose of brevity), each of which can be defined as "active" device component in that each explosive charge mass is capable of generating an explosive shock wave by way of releasing internally-stored explosive energy (e.g., each explosive charge mass itself within the set of explosive charge masses is detonable); and (b) a non-explosive wave shaping structure, which can be defined as a "passive" device component in that the wave shaping structure itself does not or need not include any explosive composition therein, and does not or need not internally store explosive energy (e.g., the wave shaping structure itself is non-detonable, or explosively inert from a chemical composition perspective). The body structure includes a set of internal volumes, chambers, or cavities in which the set of explosive charges and the wave shaping structure reside. The set of explosive charges and the wave shaping structure are cooperatively structured and disposed relative to each other such that the explosive device or explosive wave shaping device outputs explosive energy exhibiting a quasi-planar wave front at or adjacent (e.g., directly adjacent) to a principal output end of the body structure. Portions of this quasi-planar wave front can travel quasi-unidirectionally (e.g., in a downward direction) as the quasi-planar wave front propagates away from the principal output end of the body structure, thereby significantly, greatly, or dramatically enhancing the amount of explosive energy that propagates in an intended or target direction, and/or which is couplable or coupled into an intended or target material, substrate, or environment (e.g., geologic substrata) below the body structure's principal output end compared to a conventional explosive device that outputs explosive energy exhibiting a spherical, hemispherical, or approximately hemispherical (e.g., a prolate spheroid shape, profile, or contour, or a teardrop shape having a lower or wider region that resembles, approximates, or corresponds to a hemispherical shape) type of wave front at an analogous output end rather than a quasi-planar wave front, as further elaborated upon below.

FIGS. 1-8 are schematic illustrations showing vertical cross-sections of particular non-limiting representative embodiments of explosive devices or quasi-planar explosive shock wave generation devices 10*a-g* in accordance with the present disclosure, where such vertical cross-sections are taken through or along a central, lengthwise, longitudinal, or vertical axis (e.g., a z axis) of each such device 10*a-g*, e.g., a central axis 5 definable or defined along or through the height or depth of a body structure or body 100 of the device 10*a-g*. Unless explicitly indicated, e.g., in the context of pointing out particular distinguishing aspects of or differences between one or more representative embodiments of the explosive devices 10*a-g* shown in FIGS. 1-8, for purpose of brevity and clarity, any, some, or all of such devices 10*a-g* may be referred to using reference numeral 10 in portions of the following description, in a manner readily understood by individuals having ordinary skill in the relevant art.

In multiple embodiments, the body structure or body 100 of an explosive device 10 has a first, proximal, or upper portion 110 providing a first, proximal, or upper body end or face 112; an opposing second, distal, or lower portion 120 providing a second, distal, or lower body end or face 122, which forms the body's principal output end; and a height, depth, length, or longitudinal or axial extent between the proximal and distal ends or faces 112, 122. A set of exterior or external surfaces or outer walls 130 of the body 100 resides or extends between the body's proximal end 112 and distal end 122. The central, lengthwise, longitudinal, or vertical axis (e.g., a z axis) 5 can be defined relative to or through a centroid or center point of the body's cross-sectional area perpendicular to the central axis 5. The body 100 is commonly symmetric about the central axis 5 (e.g., along the body's height).

For purpose of simplicity and clarity with respect to the description that follows, the terms "upper," "above," or the like (e.g., "top," or "on top of") correspond to or define a spatial region, position, location, or site that is closer in relative terms to the proximal end 112 of the body 100 than the distal end 122 of the body 110 for a given point within a cross-sectional area of the body 100 perpendicular to the central axis 5; and the terms "lower," "below," or the like (e.g., "beneath" or "under") correspond to or define a spatial region, position, location, or site that is closer in relative terms to the distal end 122 of the body 100 than the proximal end 112 of the body 100 for a given point within a cross-sectional area of the body 100 perpendicular to the central axis 5. The terms "downward" and "downwardly" correspond to or define one or more spatial directions away from the proximal end 112 of the body 100 toward and/or beyond its distal end 122; and the terms "upward" and "upwardly" correspond to or define one or more spatial directions away from the distal end 122 of the body 100 toward and/or beyond its proximal end 112. Additionally, the terms "inward," "inwardly," or the like (e.g., "inner") correspond to or define one or more spatial directions toward the central axis 5, and the terms "outward," "outwardly," or the like (e.g., "outer") correspond to or define one or more spatial directions away from the central axis 5. The terms "thickness," "height," or "depth" are defined as distances parallel to or along the central axis 5. The term "cross-sectional area" is typically defined perpendicular to the central axis 5, unless otherwise stated. Additionally, the terms "lateral" and "radial" are defined with respect to a plane (e.g., an x-y plane) that is perpendicular to the central axis 5.

The aforementioned relative spatial location or direction related terms are used for purpose of simplicity and aiding understanding. Individuals possessing ordinary skill in the relevant art will understand that these relative spatial location or direction related terms can be defined in a different manner for a given explosive device 10 in accordance with an embodiment of the present disclosure, yet regardless of such terminology difference(s), the explosive device's structure remains fundamentally consistent, unchanged, or the same.

With reference again to FIGS. 1-8, in several embodiments particular portions of the body 100 geometrically resemble or correspond to a tapered cylindrical structure (e.g., particular portions of the body 100 have a generally conical or conical profile). For instance, at least part of the upper portion 110 of the body can correspond to a cylinder having a tapered region or a tapered set of first outer walls 130*a*, such that the body 100 is narrowest at its proximal end 112. Below the tapered set of first outer walls 130*a*, portions of the body 100 can correspond to a non-tapered cylinder, or a differently tapered cylinder (e.g., a more steeply sloped, yet progressively widening/slightly widening cylinder). For instance, the body 100 can include a vertical set of second outer walls 130*b* below the tapered set of first outer walls 130*a*, extending from a lower border of the tapered set of first outer walls 130*a* to the body's distal end 122. Notwithstanding, in other embodiments the body 100 can exhibit or correspond to another shape or geometry, for instance, a tapered pyramidal structure having polygonal surfaces that approximate the shape of a tapered cylinder; or a non-tapered cylinder.

The body 100 typically includes or is formed as a rigid structure, and can be manufactured using or from one or more types of polymer or plastic materials, for instance, polyurethane, nylon (e.g., nylon 6, 6), or acetal (e.g., DuPont™ Delrin®). The body 100 can be manufactured in multiple manners, such as by way of molding (e.g., injection molding), machining, and/or additive manufacturing (e.g., three dimensional (3D) printing) techniques, processes, or procedures. In some embodiments, one or more portions of the body 100 include a composition that is at least somewhat or partially degradable (e.g., by way of biodegradability and/or photodecomposition) within the explosive device's application environment, for instance, by way of one or more additives provided during body manufacture. Depending upon embodiment details, such additives can include d2W (Symphony, Hertfordshire, UK), TDPA™ (EPI Environmental Technologies Inc, BC, Canada), and/or another type of substance or chemical composition or compound. Additionally or alternatively, one or more portions of the body 100 can include or be partially composed of one or more materials that are at least somewhat or partially inherently degradable in the explosive device's application environment. Such materials that are inherently degradable can include materials that have been shown to be biodegradable or compostable (e.g., within a functionally relevant time scale) by way of various techniques and/or applicable standards, which will be readily apparent to individuals having ordinary skill in the relevant art (e.g., in Europe, EN 13432; or in the United States, ASTM D6400), or which have been or can be demonstrated to be at least somewhat or partially degradable or compostable in an application environment under consideration. Correspondingly, one or more portions of the body 100 can include one or more plant-derived plastics, including Poly-Lactic Acid (e.g., Ingeo 3251D, Natureworks LLC, MN USA); potato starch (e.g., BiomeEP1, Biome Technologies plc, Southampton UK); corn starch (e.g., PLANTIC™ RE, Plantic Technologies Limited, Australia), and/or another type of substance or chemical composition or compound. It should be noted that when the body 100 includes a set of at least somewhat or partially degradable compositions or materials, the amount of such composition(s) included in the body 100 should be sufficiently low that the slope of the shock Hugoniot remains within an intended, target, or optimal range, as further elaborated upon below.

The set of explosive charges includes at least a first, upper, or donor explosive charge mass (hereafter "donor charge" for purpose of brevity) 200 that is confined within the body 100, and which resides above (e.g., directly above) the wave shaping structure or wave shaper 300. In various embodiments, such as shown in FIGS. 2A-8, the set of explosive charges also includes a second, lower, receptor, or acceptor charge mass (hereafter "acceptor charge" for purpose of brevity) 400 that is confined within the body 100, and which resides below (e.g., directly below) the wave shaper 300.

The body 100 includes a passage, channel, slot, well, or chamber 101 therein, into which at least portions of an initiation device or initiator 20 (e.g., a detonator, an optical or laser based initiation device, or another type of initiation device depending upon embodiment details) is insertable, inserted, or disposed. The initiation device 20 is configurable, configured, or activatable for initiating or triggering the release of explosive energy by the donor charge 200, such that the donor charge 200 correspondingly or responsively generates a self-propagating explosive shock wave, as understood by individuals having ordinary skill in the relevant art. In various embodiments, the passage 101 is an elongate structure that extends from an aperture or opening formed at the proximal end 112 of the body 100 to a predetermined depth or length within the body 100, toward or to the upper end 212 of the donor charge 200. The passage 101 typically has a centroid or center point through which the central axis 5 of the body 100 extends. The passage 101 commonly has a generally cylindrical or cylindrical shape. The passage 101 can be tapered along its height or depth, e.g., such that a lower portion of the passage 101 has a larger (e.g., slightly larger) cross-sectional area perpendicular to the central axis 5 than an upper portion of the passage 101 near or at the device's proximal end 112. The passage 101 can additionally or alternatively accommodate, carry therein, or incorporate one or more types of structural features configured for aiding retention of the initiation device 20. The structural details of the passage 101 depend upon the type of initiation device 20 employed, in a manner that individuals possessing ordinary skill in the relevant art will readily comprehend. For purpose of simplicity and clarity, initiating devices 20 are not shown throughout the entirety of the FIGs., yet individuals having ordinary skill in the relevant art will clearly, directly, and unambiguously understand the manner in which an explosive device 10 in accordance with an embodiment of the present disclosure and an initiation device 20 are configured for cooperative engagement and operation with each other.

The donor charge 200 can be configured for generating explosive energy (e.g., a donor charge shock wave) providing a donor charge wave front exhibiting a generally or approximately hemispherical spatial profile or distribution. The wave shaper 300 is configured for (a) receiving particular downwardly propagating portions of the donor charge wave front at particular times; (b) altering, transforming, or reshaping the spatial profile or distribution of those portions of the donor charge wave front that the wave shaper 300 has received up to a given time relative to other downwardly propagating portions of the wave front that the wave shaper 300 has not yet received, but will receive; and (c) outputting a substantially downwardly propagating transformed shock wave having a wave front that exhibits a non-hemispherical, quasi-planar spatial profile or distribution, and which can serve as a shock initiation source for initiating the acceptor charge 400. In response to its initiation by the quasi-planar wave front received from the wave shaper 300, the acceptor charge 400 generates explosive energy providing an acceptor charge wave front that correspondingly has a similarly non-hemispherical, quasi-planar spatial profile or distribution, and which can be coupled into a target material, substrate, or environment external to the explosive device 10.

Each of the donor charge 200 and the acceptor charge 400 includes at least one type of energetic formulation or explosive composition or compound. A wide variety of explosive compositions or compounds are suitable for use in explosive devices 10 in accordance with embodiments of the present disclosure. Typically, each of the donor charge 200 and the acceptor charge 400 includes or is a secondary explosive composition. Suitable secondary explosive compositions include pentaerythritol tetranitrate (PETN); a blend of trinitrotoluene (TNT) and PETN, e.g., 50% TNT and 50% PETN, generally referred to as Pentolite, which can vary in the relative proportions of the two main components and can include other components; Composition B (50% trinitrotoluene (TNT) and 50% cyclotrimethylenetrinitramine, where cyclotrimethylenetrinitramine is generally referred to as Research Department eXplosive (RDX); pressed RDX, which is a combination of RDX and a wax (e.g., 90% RDX and 10% wax); and PBX (92% PETN and 8% inert polymer).

In several embodiments, the donor charge 200 and the acceptor charge 400 are each formed of the same type of explosive composition. For instance, in a non-limiting representative implementation, each of the donor charge 200 and the acceptor charge 400 includes Pentolite (e.g., the donor charge 200 and the acceptor charge 400 can each carry or be formed of an identical Pentolite formulation), which can provide a good balance of explosive performance and safety. In other embodiments, the donor charge 200 and the acceptor charge 400 are formed of different types of explosive compositions. For a given explosive device 10, particular set of energetic formulations or compositions for the donor charge 200 and/or the acceptor charge 400 can be selected in accordance with the reaction rate(s) of the explosive composition(s) and/or explosive reaction zone thickness(es) thereof, such that the quasi-planar shock wave output by the explosive device 10 exhibits a desired or required duration and/or acoustic or sonic frequency content or frequency spectrum (e.g., which is suitable or well-suited to a given explosive application or environment under consideration, such as seismic exploration). Thus, the frequency content of an explosive device 10 in accordance with an embodiment of the present disclosure can be established, selected, or customized based on the energetic properties of the donor charge 200 and/or the acceptor charge 400. Individuals having ordinary skill in the relevant art will understand that the selection of a given type of donor charge or acceptor charge explosive composition can influence or determine the range of techniques by and/or relative ease with which an explosive device 10 in accordance with an embodiment of the present disclosure can be manufactured.

The donor charge 200 includes a first or upper end 212 and a second or lowest end 222, where the upper end 212 of the donor charge 200 is closer to the proximal end 112 of the body 100 than the lowest end 222 of the donor charge 200. At the lowest end 222 of the donor charge 200, the body 100 has a predetermined thickness perpendicular to the central axis 5, i.e., lowest end 222 of the donor charge 200 is laterally or horizontally offset away from the outer wall(s) 130 of the body 100 by a predetermined minimum distance, as further detailed below.

The donor charge 200 also includes a set of peripheral surfaces that extend downwardly and outwardly, from the donor charge's upper end 212 to its lowest end 222. More specifically, the donor charge 200 includes a first or upper set of peripheral surfaces 230 sloping downwardly and outwardly toward the body's exterior walls(s) 130; and a second or lower set of peripheral surfaces 240 disposed closer to the body's distal end 122 than the upper set of peripheral surfaces 230, also sloping downwardly and outwardly toward the body's exterior walls(s) 130. The donor charge 200 additionally includes an intermediate point or end 214 (which can also be referred to as an indented point of the donor charge 200) disposed along the central axis below its upper end 212, where the intermediate end 214 resides above the donor charge's lowest end 222. The intermediate end 214 of the donor charge 200 defines a donor charge position or location at which the lower set of peripheral surfaces 240 intersects the central axis 5.

In view of the foregoing, in various embodiments the shape or structure of the donor charge 200 corresponds, approximately corresponds, or generally corresponds to or resembles a frustum of material that has a conical recess or void formed therein, where the conical recess defines the donor charge's intermediate end 214 and lower set of peripheral surfaces 240. The intermediate end 214 may therefore be referred to as a tip of this conical recess or void. The donor charge 200 carries one or more types or explosive compositions or compounds within its volume above this conical recess. For instance, in multiple embodiments the donor charge 200 geometrically corresponds, approximately corresponds, or generally corresponds to or is mathematically correlated with or resembles portions of a right circular frustum (i.e., a right circular cone truncated perpendicular to its axis of symmetry) of material (where the material includes one or more types or explosive compositions or compounds) having a right circular conical recess therein. More particularly, in several embodiments the donor charge's upper end 212, set of upper peripheral surfaces 230, and lowest end 222 correspond, approximately correspond, or generally correspond to a doubly-truncated first right circular cone, i.e., a first right circular cone having a horizontal first truncation associated with or corresponding to the donor charge's upper end 212, and a vertical second truncation associated with or corresponding to the donor charge's lowest end 222. More specifically, in such embodiments the doubly-truncated donor charge 200 corresponds to a first right circular cone that has been (a) horizontally truncated (e.g., by a horizontal plane) proximate to the first right circular cone's vertex; and (b) vertically truncated (e.g., by a cylinder) at a predetermined radial or axial distance away from the central axis 5, around the central axis 5. Moreover, the donor charge's intermediate end 214 and set of lower peripheral surfaces 240 correspond to the apex and lateral surface, respectively, of a second right circular cone that sits or defines a recess within this doubly-truncated first right circular cone, where the larger or lower base of the first right circular cone and the base of the second right circular cone share the same center point (through which the body's central axis 5 extends) and reside in a common plane, and the smaller or upper base of the perpendicularly truncated first right circular cone and the vertex of the second right circular cone are oriented in the same direction toward the proximal end of the body 10. At its lowest end 222, such a donor charge 200 spans or extends across a predetermined circular cross-sectional area perpendicular to the central axis 5 of the body 100, which corresponds to the radial distance away from the central axis 5 at which the aforementioned vertical truncation of the first right circular cone occurs. This type of doubly-truncated first cone can be referred to or defined as a quasi-cone, and thus such a donor charge 200 can be referred to or categorized or defined as non-cylindrical and quasi-conical in terms of its overall structure.

Individuals having ordinary skill in the relevant art will understand that in alternate embodiments, one or more portions of the donor charge 200 need not correspond to a cone having smooth lateral surfaces, but rather one or more portions of the donor charge 200 can be cone-like or approximately conical, e.g., at least some portions of the donor charge 200 can include or be formed as polygonal regions or surfaces such that the overall shape of the donor charge 200 resembles or approximately resembles a cone, e.g., a pyramidal cone. Individuals having ordinary skill in the relevant art will further recognize that the donor charge 200 need not closely resemble a cone, but instead can exhibit another shape, e.g., a pyramidal shape that is readily distinguishable from a conical shape. However, the use of a donor charge 200 having portions that correspond to or which resemble (e.g., closely resemble) a cone can reduce, minimize, or optimize the mass of explosive material(s) that the donor charge 200 needs to carry for the explosive device 10 to function as intended.

As will be understood by individuals having ordinary skill in the relevant art in view of the preceding description directed to the initiating device 20 and the passage 101, the donor charge 200 is typically initiated at an initiation region or site located at and/or proximate to (a) the donor charge's upper end 212, and (b) the central axis 5 of the body 100. The aforementioned horizontal truncation of the donor charge 200 proximate to the first right circular cone's vertex eliminates any donor charge structural singularity that can unpredictably or adversely affect the generation of a self-propagating shock wave within the donor charge 200. Following its initiation, the donor charge 200 releases explosive energy in the form of a shock wave exhibiting a hemispherical or approximately hemispherical wave front, which propagates radially outward with respect to the initiation site. For purpose of simplicity and brevity, in the description that follows the shock wave generated by the donor charge 200 is considered to exhibit a hemispherical wave front. In various embodiments, the donor charge 200 has a thickness or height along the central axis 5 between its upper end 212 and its intermediate end 214 that is sufficient to enable the shock front generated within the donor charge 200 to propagate, transition, or run up to detonation by the time it reaches the donor charge's intermediate end 214 (e.g., by the time the hemispherical shock front generated by the donor charge 200 arrives at the donor charge's intermediate end 214, the hemispherical shock wave has transitioned into a hemi spherical detonation front).

The wave shaper 300 is disposed below or adjacent (e.g., directly adjacent) to the donor charge's intermediate end 214 and lower peripheral surface(s) 240, such that the wave shaper 300 receives downwardly-traveling portions of the hemispherical wave front generated by the donor charge's release of explosive energy. The wave shaper 300 includes at least one type of material structured and/or shaped for selectively affecting or attenuating the propagation speed of downwardly propagating portions of the wave front received from the donor charge 200 as a function of time relative to other downwardly propagating portions of the wave front that the wave shaper 300 has not yet received from the donor charge 200. More particularly, the wave shaper 300 is cooperatively structured or shaped relative to the structure or shape of the donor charge 200 such that after downwardly propagating portions of the hemispherical wave front received by the wave shaper 300 have propagated into and through the wave shaper 300, a terminal surface 322 of the wave shaper 300 outputs a downwardly propagating first quasi-planar or essentially planar shock wave across at least 40%-70% (e.g., 50%-60%), or across the majority, or across essentially the entirety of the cross-sectional area of its terminal surface 322 perpendicular to the body's central axis 5. The wave shaper 300 thus transforms downwardly propagating portions of the hemispherical wave front (e.g., a hemispherical detonation front) received from the donor charge 200 into a first quasi-planar wave front that is output at the wave shaper's terminal surface 322, and which further propagates downwardly therefrom.

The wave shaper 300 has a top end, peak, apex, or tip 314 that interfaces with or abuts the intermediate end 214 of the donor charge 200. The terminal surface 322 of the wave shaper 300 is disposed a predetermined distance away from the wave shaper's top end 314, and resides or approximately resides in a plane perpendicular to the body's central axis 5. The wave shaper 300 also includes a set of lateral surfaces 330 that extend downwardly and outwardly from the wave shaper's top end 314 to its terminal surface 322, thus the wave shaper 300 has a cone or conical shape (which may have a circular, elliptical or polygonal base), with its tip at the top end 314, that corresponds to and fits with the void defined by the donor charge 200 (which exhibits the geometric shape that is correlated with or which corresponds to the second cone). Typically, the wave shaper's set of lateral surfaces 330 abut the donor charge's set of lower peripheral surface(s) 240. The wave shaper's terminal surface 322 has a predetermined cross-sectional area perpendicular to the central axis 5 (e.g., the terminal surface 322 is typically circular), which is the wave shaper's maximum cross-sectional area. In various embodiments, the cross-sectional area of the terminal surface 322 of the wave shaper 300 matches and is aligned (e.g., precisely aligned) with the cross-sectional area of the lowest end 222 of the donor charge. Thus, the wave shaper 300 does not extend to the outer wall(s) 130 of the body 100, but instead is laterally or horizontally disposed inward of the outer wall(s) 130 by the same predetermined distance as the lowest end 222 of the donor charge 200.

Because the wave front of the explosive energy generated by the donor charge 200 is hemispherical and propagates radially away from an initiation site located at and/or proximate to the upper end 212 of the donor charge 200 at and/or proximate to the central axis 5 of the body 100, with respect to a given horizontal cross-sectional area or "slice" of the wave shaper 300, i.e., perpendicular to the central axis 5 of the body 100, that resides proximate to the wave shaper's top end 314 (i.e., a perpendicular "slice" of the wave shaper 300 that is closer to the wave shaper's top end 314 than its terminal surface 322), locations within this wave shaper cross-sectional area that are closer to the central axis 5 receive downwardly propagating portions of the hemispherical wave front generated by the donor charge 200 earlier in time than locations within this wave shaper cross-sectional area that are further from the central axis 5. In order to enhance or increase the planarity of earlier-received downwardly propagating portions of the hemispherical wave front generated by the donor charge 200 relative to later-received downwardly propagating portions of this hemispherical wave front, the wave shaper 300 is structured such that (a) those portions of the downwardly propagating hemispherical wave front that the wave shaper 300 receives earlier in time have their speed attenuated during their propagation within the wave shaper 300 over a longer distance, and hence a longer time interval, than those portions of the downwardly propagating hemispherical wave front that the wave shaper 300 receives later in time; and (b) at the wave shaper's terminal surface 322, the original hemispherical wave front that was received by the wave shaper 300 and which has propagated through and is output by the wave shaper 300 has been transformed into the first quasi-planar wave front.

In view of the foregoing, in various embodiments the wave shaper 300 includes or is formed of a rigid and/or solid piece of material having a thickness or height that varies with distance away from the central axis 5. More particularly, the wave shaper 300 is thickest or tallest along the body's central axis 5 (i.e., between the wave shaper's top end 312 and its terminal surface 322 along the central axis 5).

The wave shaper 300 typically exhibits a triangular or approximately triangular two dimensional (2D) profile within a vertical cross-section of the device 10 taken along the central axis 5 based on its cone or conical shape. Also, as indicated above, at its terminal surface 322, the wave shaper's cross-sectional area or diameter perpendicular to the central axis 5 approximately defines or defines the cross-sectional area or diameter, respectively, spanned by the donor charge's lowest end 222. In general, the upwardly facing portions of the wave shaper 300, i.e., the wave shaper's top end 314 and set of lateral surfaces 330, correspond or conform to the geometry of the donor charge's set of lower surfaces 240. Thus, the geometry of the wave shaper 300 is correlated with or depends upon the geometry of the donor charge 200 (and vice versa). The set of lateral surfaces 330 define a conical face or surface that faces the donor charge 200 and that defines the upper face of the cone or conical shape of the wave shaper 300. Regardless of the details of any given embodiment, the wave shaper 300 is designed, configured, or structured such that following the donor charge's release of explosive energy exhibiting a hemispherical or generally hemispherical wave front, the wave shaper 300 transforms downwardly propagating portions of this wave front to become quasi-planar by the time the wave front has propagated through the wave shaper 300 and has reached the wave shaper's terminal surface 322.

The wave shaper 300 includes or is formed as a rigid structure, and can be manufactured from one or more types of polymer or plastic materials, such as polyurethane or nylon 6, 6. The wave shaper 300 can be manufactured in multiple manners, such as by way of molding (e.g., injection molding), machining, and/or additive manufacturing (e.g., 3D printing) techniques, processes, or procedures. Depending upon embodiment details, the wave shaper 300 and the body 100 can be manufactured together as an integral unit (e.g., simultaneously in the same manufacturing process or procedure); or the wave shaper 300 can be manufactured separately from the body 100, and inserted, affixed, or adhered therein. Further depending upon embodiment details, the wave shaper 300 can be formed of the same material(s) as the body 100, or the wave shaper 300 can carry one or more materials that the body 100 does not include. Also, the wave shaper 300 can be composed of one or more types of materials and/or include one or more types of additives that facilitate or enable wave shaper degradability in the explosive device's application environment, such as indicated above for the body 100.

In an explosive device 10*a* such as that shown FIG. 1, the set of explosive charges includes only the donor charge 200 and the wave shaper 300, i.e., no acceptor charge 400 is present. This type of embodiment can be useful in applications in which further explosive amplification of the quasi-planar shock wave output by the wave shaper 300 is not required, and this quasi-planar shock wave can be coupled or delivered into a material, substrate, or environment external to the device 10*a* to achieve an intended result.

As indicated in several representative embodiments of explosive charges 10*b-h* shown in FIGS. 2A-8, an explosive device 10 can also include an acceptor charge 400 in addition to the donor charge 200. The acceptor charge 400 resides below the wave shaper 300, and carries at least one type of explosive composition or compound therein. More particularly, the acceptor charge 400 includes an upper surface 412 disposable or disposed adjacent (e.g., directly adjacent) to the terminal surface 322 of the wave shaper 300; a lower or bottom surface 422 disposable or disposed at a predetermined distance below the upper surface 412, e.g., such that the lower surface 422 opposes the upper surface 412 and is typically coincident with the terminal end 122 of the body 100; and a set of peripheral surfaces 430 extending between the upper and lower surfaces 412, 422 along an acceptor charge thickness or height.

The first quasi-planar shock wave output at the terminal surface 322 of the wave shaper 300 serves as a shock initiation source for initiating the acceptor charge 400. The acceptor charge 400 is configured for explosively amplifying the first quasi-planar shock wave while retaining or approximately maintaining wave front quasi-planarity to generate a second quasi-planar shock wave that is output at the acceptor charge's lower surface 422 (e.g., such that the spatial distribution, profile, or curvature and directionality of the second quasi-planar shock wave are nearly or essentially identical to the spatial distribution, profile, or curvature and directionality of the first quasi-planar shock wave). The thickness of the acceptor charge 400 is commonly selected such that the second quasi-planar shock wave has run up to detonation at least by the time it reaches the lower surface 422 of the acceptor charge 400, and thus at its lower surface 422, the acceptor charge 400 outputs a quasi-planar detonation front that propagates downwardly away from the distal end 122 of the body 100.

The wave shaper 300, the donor charge 200, and the acceptor charge 400 are cooperatively aligned relative to each other such that the maximum lateral or horizontal spatial extent or span of the wave shaper 300 coincides with, limits, approximately establishes, or establishes the maximum lateral or horizontal spatial extent or span of the donor charge 200 and the acceptor charge 400. Moreover, none of the donor charge, the wave shaper 300, and the acceptor charge 400 laterally or horizontally extend to the outer wall(s) of the body 100, but rather their maximum lateral or horizontal spatial extent perpendicular to the central axis 5 coincides with or is determined by the perpendicular cross-sectional area of the terminal surface 322 of the wave shaper 300. That is, the acceptor charge 400 has a perpendicular cross-sectional area that does not extend to the outer wall(s) 130 of the body 100, but rather is laterally or horizontally disposed inward of the body's outer wall(s) 130 by the same predetermined distance as the terminal surface 322 of the wave shaper 300 and the lowest end 222 of the donor charge 200. This predetermined distance can be determined, e.g., as a minimum body width perpendicular to the central axis 5, by the material properties of the body 100. More particularly, this predetermined distance can correspond to or be defined by a minimum or consistently reliable body material width for which no significant of the body 100 (e.g., less than 5-15% deformation of those portions of the body's terminal end 122 that extend along the thickness or height of the acceptor charge 400) occurs where the terminal surface 322 of the wave shaper 300 interfaces with the upper surface 412 of the acceptor donor charge 400 when the acceptor charge 400 is initiated by the quasi-planar shock wave output at the wave shaper's terminal surface 322.

The aforementioned vertical truncation of the frustum or first cone corresponding to the donor charge 200 occurs at the lateral, horizontal, or radial border(s) or radius of the wave shaper's terminal surface 322. Thus, the quasi-conical donor charge 200 is not entirely or wholly conical. Rather, proximate to its lowest end 222, a cylinder-like, generally cylindrical, approximately cylindrical, or cylindrical donor charge lower section or segment 220 is vertically aligned with and directly adjacent to the terminal surface 322 of the wave shaper 300, and extends upwards from the lowest end 222 of the donor charge 200 about or around the periphery of the wave shaper's terminal surface 322 by a predetermined thickness or height, above which the conical, approximately conical, or generally conical upper peripheral surface(s) 230 of the donor charge 200 extend or taper towards the donor charge's upper end 212. In an alternate embodiment, the lower donor charge section 220 can be slightly conical, e.g., corresponding to a cone having a lateral surface that is nearly vertical. The presence of the lower donor charge section 220 allows or ensures that the shock wave in the donor charge maintains full detonation as it travels along the entirety of the wave shaper's lateral surface(s) 330, thereby eliminating undesirable or excessive curvature at the outer edge(s) of the shock wave progressing into and through the acceptor charge 400. Depending upon embodiment details, the thickness or height of the lower donor charge section 220 relative to the overall donor charge thickness or height can be approximately 2.5%-7.5%, e.g., approximately 5%. Furthermore, explosive devices 10 in accordance with several embodiments of the present disclosure having different overall donor charge thicknesses or heights can have an identical lower donor charge section thickness or height.

The cooperative structural design and disposition of the donor charge 200, the wave shaper 300, and the acceptor charge 400 relative to each other as well as the outer walls 130 of the body 100 can ensure that (a) for any horizontal "slice" of the wave shaper 300 throughout the wave shaper's thickness or height, a downwardly propagating shock wave remains at steady state detonation across the horizontal "slice" of the wave shaper 300 including at the wave shaper's lateral surface(s) 330; (b) the quasi-planar shock wave output at the terminal surface 322 of the wave shaper 300 is at steady state detonation across the entirety of the surface area of the terminal surface 322 of the wave shaper 300 and the entirety of the surface area of the upper surface 412 of the acceptor charge 400 at the onset of propagation therein, thereby reducing the extent to which the shock wave output by the explosive device 10 exhibits non-planarity toward portions of the explosive device's outer walls 130 near the device's distal end 122.

Further to the foregoing, explosive devices 10 in accordance with various embodiments of the present disclosure can output a quasi-planar shock wave at their terminal ends 122 regardless of the type(s) of explosive compositions or energetic formulations confined therein, and regardless or independent of whether the VoD corresponding to the donor charge 200 is less than, equal to, or greater than the VoD corresponding to the acceptor charge 400, enabling highly flexible selection of donor charge energetic properties and acceptor charge energetic properties essentially independent of each other. In various embodiments, the energy release properties of the donor charge 200 are consistent or constant throughout the thickness or height of the donor charge 200; however, the energy release properties of the acceptor charge 400 can be constant or vary as a function of acceptor charge thickness or height depending upon embodiment details.

Explosive devices 10 in accordance with the present disclosure can exhibit multiple variations in structural configuration and/or material composition, depending upon embodiment details and/or application objectives or requirements. Individuals having ordinary skill in the relevant art will understand that the structural and/or compositional characteristics, properties, or details of an explosive device 10 in accordance with embodiments of the present disclosure can depend upon the particular type of explosive application or blasting operation (e.g., a commercial blasting operation) in which the explosive device 10 is deployed or used, and/or conditions in the explosive device's external environment. A number of non-limiting representative embodiment variations in accordance with the present disclosure are further elaborated upon hereafter.

As previously indicated, in certain embodiments such as shown in FIG. 1, an explosive device 10*a* includes a donor charge 200, but is not configured to engage, interface, or mate with or carry an acceptor charge 400 (e.g., the distal end 122 of such a device 10*a*, at which the quasi-planar shock wave is output, approximately coincides or coincides with the terminal surface 322 of the wave shaper 300).

With respect to embodiments of explosive devices 10*b-h* that are configured for carrying an acceptor charge 400, in several of such embodiments such as shown in FIGS. 2A, 2B, and 5-8, the body 100 of the explosive device 10*b*, 10*e-g* is a unitary structure, and the acceptor charge 400 is formed or fabricated within the body 100 as part of explosive device manufacture (e.g., such that the acceptor charge 400 is inserted or formed in or built into the unitary body 100 during explosive device manufacture, and is intended to be non-removable or securely/permanently fixed in position with respect to the unitary body 100 once disposed therein). However, in other embodiments such as shown in FIGS. 3-4, the body 100 is a non-unitary structure, and the explosive device 10*d,e* includes multiple couplable or connectable sections that can be selectively engaged, mated, or attached to each other, and possibly disengaged or detached from each other.

Further to the foregoing, different embodiments of explosive devices 10 can vary with respect to one or more of (a) acceptor charge cross-sectional areas perpendicular to the central axis 5, and correspondingly maximum donor charge and maximum wave shaper perpendicular cross-sectional areas; (b) overall donor charge height, and correspondingly overall acceptor charge height; and (c) net explosive mass, where the net explosive mass of a given explosive device 10 can be defined as the total mass of explosive material(s) provided by the donor charge 200 and the acceptor charge 400. For instance, FIG. 6 illustrates an embodiment of an explosive device 10*f* for which the cross-sectional area of the acceptor charge 400 perpendicular to the central axis 5, and hence the maximum cross-sectional area of the wave shaper 300 and the donor charge 200 perpendicular to the central axis 5, can be smaller than the counterpart or corresponding cross-sectional areas for the explosive devices 10*b-e* shown in FIGS. 2-5; and the overall height of each of the donor charge 200 and the wave shaper 300 can be respectively larger than the overall height of each of the donor charge and the wave shaper for the explosive devices 10*b-e* shown in FIGS. 2A-5. The net explosive mass of the device 10 shown in FIG. 6 can be less than that of the explosive devices shown in FIG. 2A-5.

Figure 3:
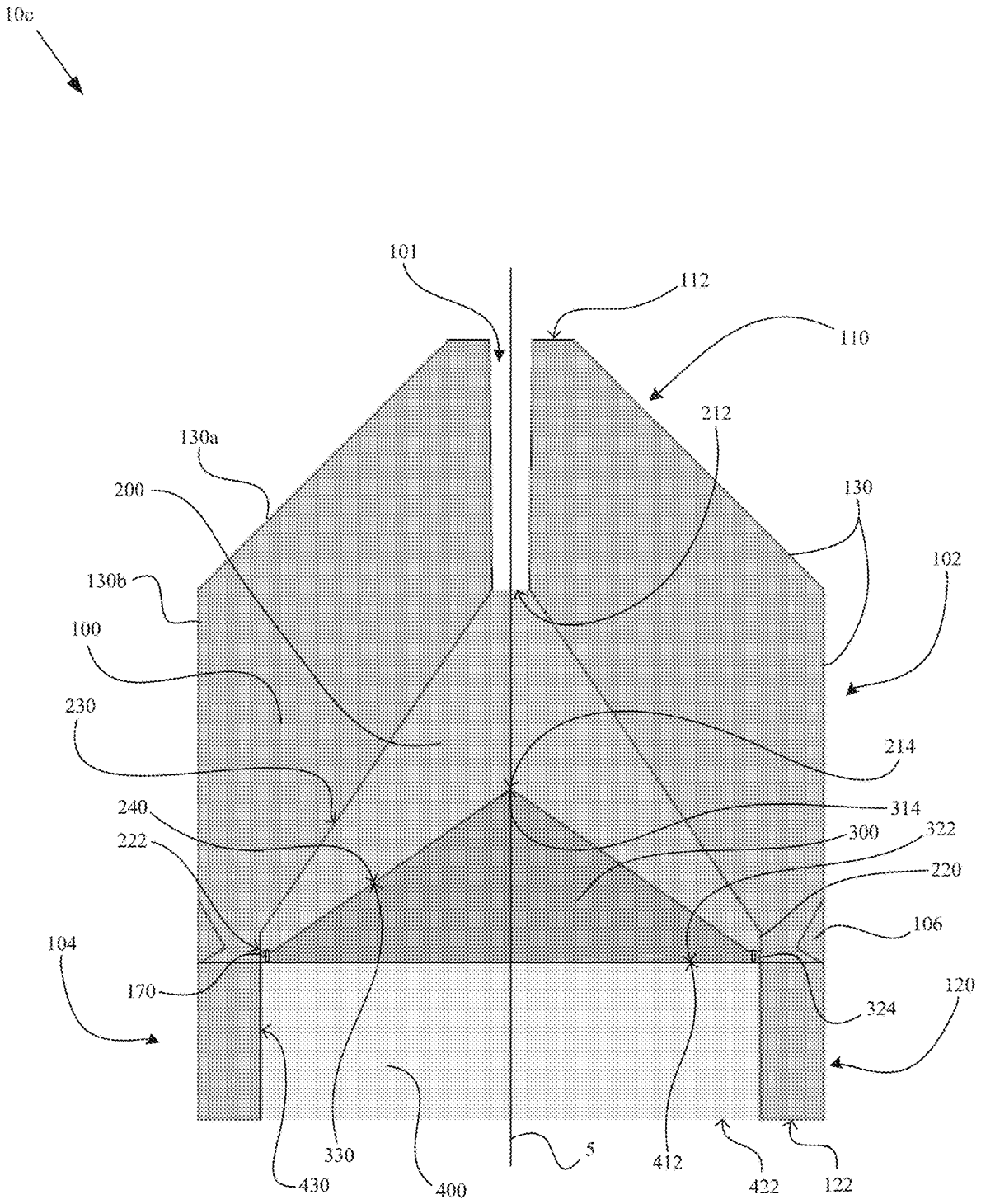
FIG. 3 is a cross-sectional schematic illustration of an explosive device in accordance with particular embodiments of the present disclosure, which provides a body structure having an upper piece and a lower piece couplable or attachable to the lower piece via a snap-fit connection, wherein the upper section carries a donor charge and a wave shaper, and the lower section carries an acceptor charge.
Figure 4:
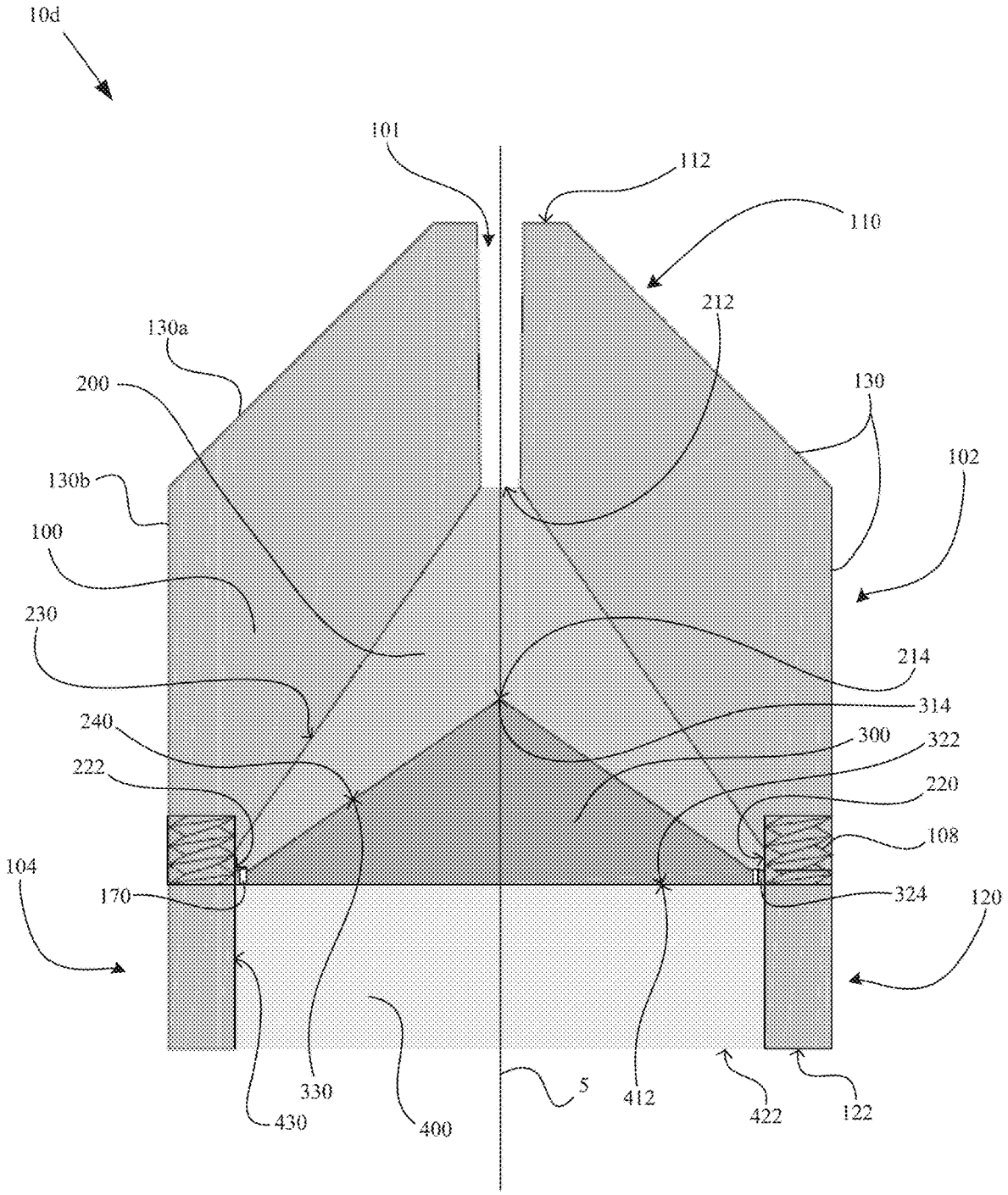
FIG. 4 is a cross-sectional schematic illustration of an explosive device in accordance with particular embodiments of the present disclosure, which provides a body structure having an upper piece and a lower piece couplable or attachable to the lower piece via a threaded connection, wherein the upper section carries a donor charge and a wave shaper, and the lower section carries an acceptor charge.
Figure 5:
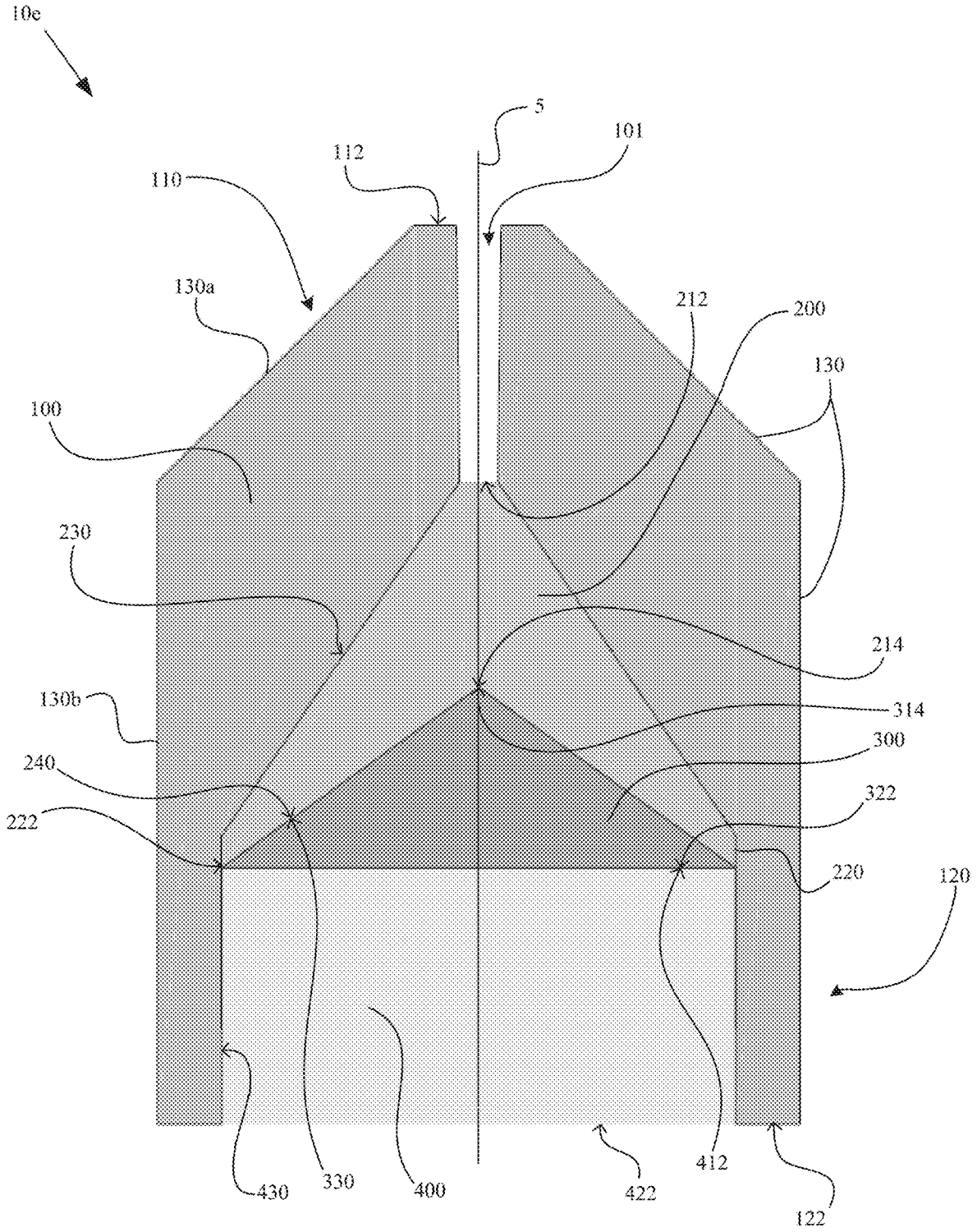
FIG. 5 is a cross-sectional schematic illustration of an explosive device in accordance with another embodiment of the present disclosure, illustrating a manner in which an acceptor charge height can differ relative to acceptor charge heights for the explosive devices shown in FIGS. 2A-4.
Figure 6:
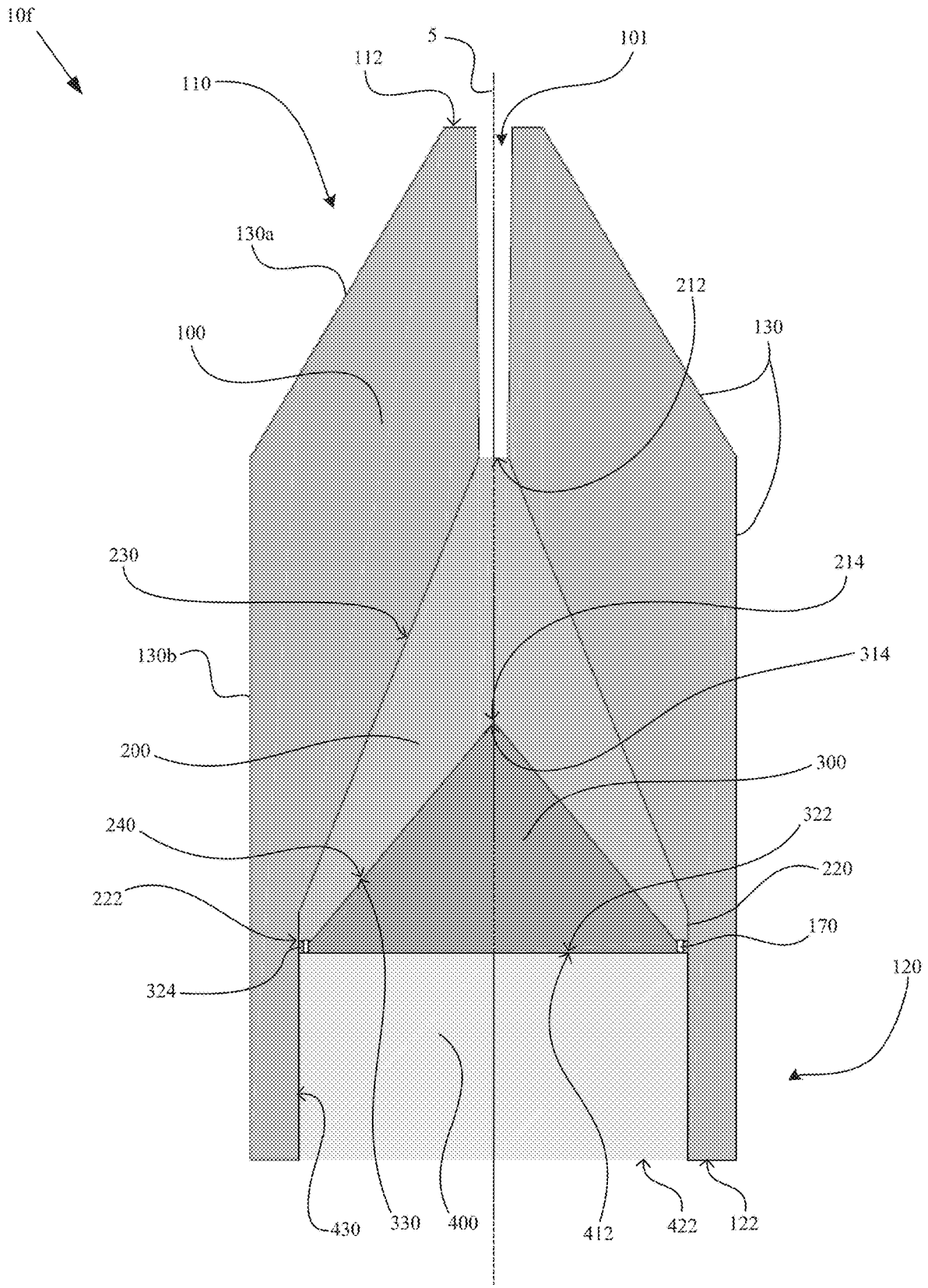
FIG. 6 is a cross-sectional schematic illustration of an explosive device in accordance with a further embodiment of the present disclosure, illustrating a manner in which a cross-sectional area of the acceptor charge can be smaller than counterpart or corresponding cross-sectional acceptor charge areas for the explosive devices shown in FIGS. 2A-5, and an overall height of each of the donor charge and the wave shaper can be respectively larger than overall heights of each of the donor charge and the wave shaper for the explosive devices shown in FIGS. 2A-5.

Still further, the thickness or height of the acceptor charge 400 can differ depending upon embodiment and/or explosive device application or environment details, such as indicated by the explosive device 10*e* shown in FIG. 5 compared to that shown in FIGS. 2A-4; and/or the type(s) of explosive composition(s) provided by the acceptor charge 400 can differ depending upon embodiment details. Thus, the energy release properties and/or the amount of stored explosive energy provided by the acceptor charge 400 can differ or be selected or customized depending upon embodiment and/or device application or deployment environment details.

In several embodiments, an explosive device 10*c,d* can include a first or upper section or piece 102 that carries the donor charge 200 and the wave shaper 300; and a second, lower, or base section or piece 104 that carries or retains the acceptor charge 400, and which can be selectively coupled, engaged, mated, or connected to the upper piece 102. The lower piece 104 in which the acceptor charge 400 resides typically forms a disk or "puck" of explosive material(s). The upper piece 102 and the lower piece 104 can be coupled or connected by way of counterpart snap-fit structures 106 that enable snap-fit engagement between the upper and lower pieces 102, 104, such as shown in FIG. 3; or counterpart rotational or screw thread structures 108 that enable rotational or screw-type engagement of the upper and lower pieces 102, 104, such as shown in FIG. 4. These or other types of engagement structures 106, 108 can be carried by (e.g., extend or project from, and/or be formed within)

predetermined portions of the upper and lower pieces 102, 104, such as portions of the non-unitary body's outer walls 130, in a manner readily understood by individuals having ordinary skill in the relevant art. In each of the embodiments shown in FIGS. 3-4, the lower piece 104 of the body 100 securely retains the acceptor charge 400 therein.

Further to the foregoing, an explosive device 10*c-d* such as shown in FIGS. 3-4 can include an upper piece 102 providing a predetermined mass of donor charge 200, which is couplable to multiple different or distinct lower pieces 104 (e.g., non-identical lower pieces 104). Each such lower piece 104 provides or retains an acceptor charge 400 providing at least one predetermined explosive composition or compound of predetermined mass. Different lower pieces 104 can retain different acceptor charge masses, and/or different acceptor charge explosive compositions or compounds therein. Thus, different lower pieces 104 can have different explosive energy release or output characteristics or properties (e.g., different or distinguishable quasi-planar shock wave amplitude, frequency content, duration, and/or velocity at the acceptor charge's lower surface 422) relative to each other. A specific lower piece 104 can be selected for coupling or be coupled to the upper piece 102 relative to the other lower pieces 104 based on whether the quasi-planar shock wave that the explosive device 10*c,d* will output by way of the specific lower piece 104 is suitable, better-suited, or best-suited to a given explosive application or environment under consideration compared to the other lower pieces 104.

In a related embodiment, multiple lower pieces 104 (e.g., two or more lower pieces 104) can be selectively coupled or joined together to form a cooperatively aligned (e.g., directly vertically aligned with respect to the central axis 5) stack of lower pieces 104, thus providing a stack of donor charges 400, which can be selectively coupled or joined with an upper piece 102 such as that described above. In such embodiments, different lower pieces 104 (e.g., two lower pieces 104, which carry first and second acceptor charges 400 that can be identical or different with respect to acceptor charge thickness/net explosive mass, explosive composition, and/or energy release properties) can be coupled or joined together by way of compatible or counterpart engagement structures, such as snap-fit or rotational or screw-type engagement structures.

Hence, an explosive device 10*c-d* such as shown in FIGS. 3-4 can have an upper piece 102 that is engageable (e.g., directly matingly engageable) with any one of multiple lower pieces 104. Depending upon embodiment details, one or more of such lower pieces 104 can be (a) engageable (e.g., directly matingly engageable) with another lower piece 104 to form a stack of lower pieces 104, e.g., creating or providing "stacked pucks" of donor charges 400; or (b) non-engageable (e.g., not directly matingly engageable) with another lower piece 104. For a given upper piece 102 under consideration, multiple lower pieces 104 can be interchangeably coupled to the upper piece 102 (and thus multiple lower pieces 104 can be defined as interchangeable with respect to each other for this upper piece 102).

In embodiments such as shown in FIGS. 3-4, a single top piece 102 can be selectively or customizably coupled to any one lower piece 104 from among multiple lower pieces, or possibly two (or more) stacked lower pieces 104, thus facilitating, enhancing, or maximizing explosive device deployment and/or operational flexibility in accordance with application and/or environmental objectives, requirements, or constraints. The final, as-deployed, or in-use energy release characteristics of one or more explosive devices 10*c-d*, each of which includes multiple joinable/separable pieces 102, 104 can be established, selected, tailored, customized after the manufacture of the explosive device pieces 102, 104, prior to explosive device use. More particularly, after the manufacture of (i) a top piece 102 providing a particular donor charge 200, and (ii) multiple lower pieces 104 that each provide or retain a distinct or different acceptor charge 400 (e.g., with respect to explosive composition type(s) and/or formulation(s) therein, and/or the mass(es) thereof), an assembled explosive device 10*c-d* can be formed (e.g., shortly before or effectively at the time of deployment, in the field) by coupling or mating the top piece 102 with a single selected lower piece 104, or possibly a stack of multiple selected lower pieces 104, which can output a quasi-planar shock wave having intended, expected, or desired peak amplitude, duration, and/or frequency content.

Thus, multiple embodiments in accordance with the present disclosure provide an explosive device 10*c-d* for which the device's energy release characteristics can be established, (re)configured, selected, adjusted, changed, or customized after fabrication of those portions of the explosive device 10*c-d* that carry, contain, or confine its explosive composition(s), and prior to explosive device use or deployment, for instance, "on the go" or "on the fly" in the field, e.g., on a flexible or dynamic basis depending upon the particular application and/or environment in which the explosive device 10*c-d* will be deployed. As a non-limiting representative example, in an application such as a seismic survey in which multiple or many explosive devices 10*c-d* such as shown in FIGS. 3-4 are to be used, the energy release characteristics of one or more explosive devices 10*c-d* can be flexibly or dynamically selected or modified in the field during the progress of the seismic survey to account or compensate for unforeseen, expected, or sensed changes in geology (e.g., as indicated by data obtained during a geophysical survey) and/or signal levels (e.g., background seismic noise levels).

Figure 7:
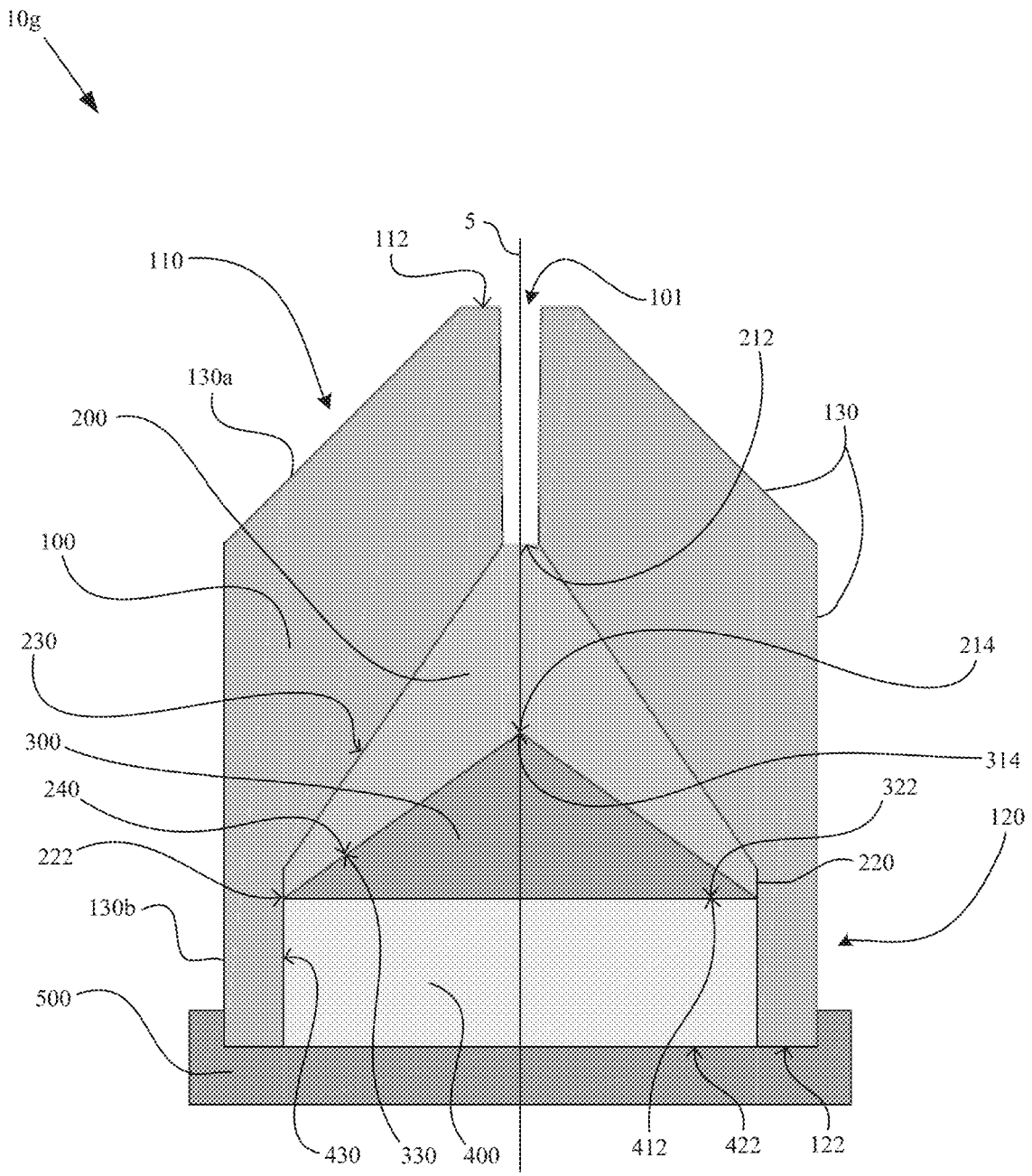
FIG. 7 is a cross-sectional schematic illustration of an explosive device having an attenuation structure, member, element, cover, or cap disposed across the distal end of its body structure in accordance with an embodiment of the present disclosure.

In yet another embodiment in accordance with the present disclosure, an explosive device 10 can be selectively couplable or coupled to or include a shock wave attenuation structure at its principal output end. For instance, FIG. 7 shows an explosive device 10*g* having an attenuation structure, member, element, cover, or cap 500 disposed across the distal end 122 of the body 100. The attenuation cap 500 is intended to overlay or cover (e.g., entirely overlay) the lower surface 422 of the acceptor charge 400, such that the attenuation cap 500 resides between (e.g., directly between) the lower surface 422 of the acceptor charge 400 (as well as the body's distal end 122) and a material or substrate into which the quasi-planar shock wave output by the explosive device 10*g* is to be coupled. The attenuation cap 500 typically provides an approximately planar or planar underside that rests upon or against portions of the material or substrate under consideration. The attenuation cap 500 can adjust or customize the amount or frequency content of the quasi-planar shock wave energy coupled or imparted into the material or substrate (e.g., the attenuation cap 500 can serve as a low pass frequency filter).

The attenuation cap 500 can be couplable, securable, or attachable/fixable to the explosive device 10*g* in one or more manners, depending upon embodiment details. For instance, the attenuation cap 500 can include a set of engagement structures, such as snap-fit or rotational or screw-type engagement structures, that enable mating engagement with the explosive device's body 100, e.g., in a manner analogous or essentially identical to that described above. Alternatively, the attenuation cap 500 can be secured to the explosive device 10*g* by way of an adhesive layer. The attenuation cap 500 can include or be formed of one or more types of materials, such as a polymer or plastic material (e.g., High Density Polyethylene (HDPE), or another type of material such as cardboard). Depending upon embodiment and/or application details, the attenuation cap 500 can additionally or alternatively provide a chemically resistant barrier between the lower surface 422 of the acceptor charge 400 and the material or substrate under consideration.

Figure 2A:
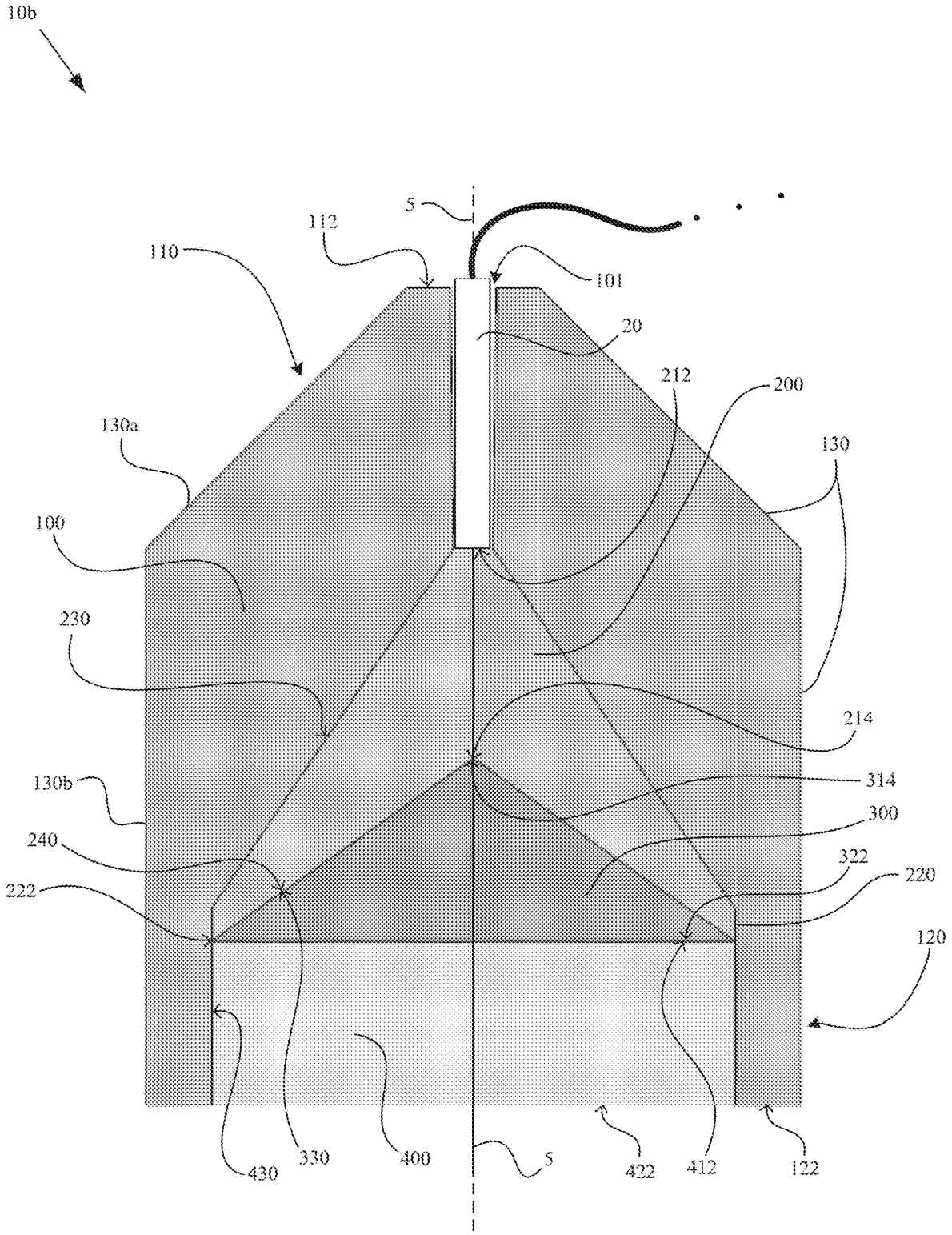
FIG. 2A is a cross-sectional schematic illustration of an explosive device in accordance with another embodiment of the present disclosure, which includes each of a donor charge, a wave shaper, and an acceptor charge that reside within an explosive device body structure.
Figure 2B:
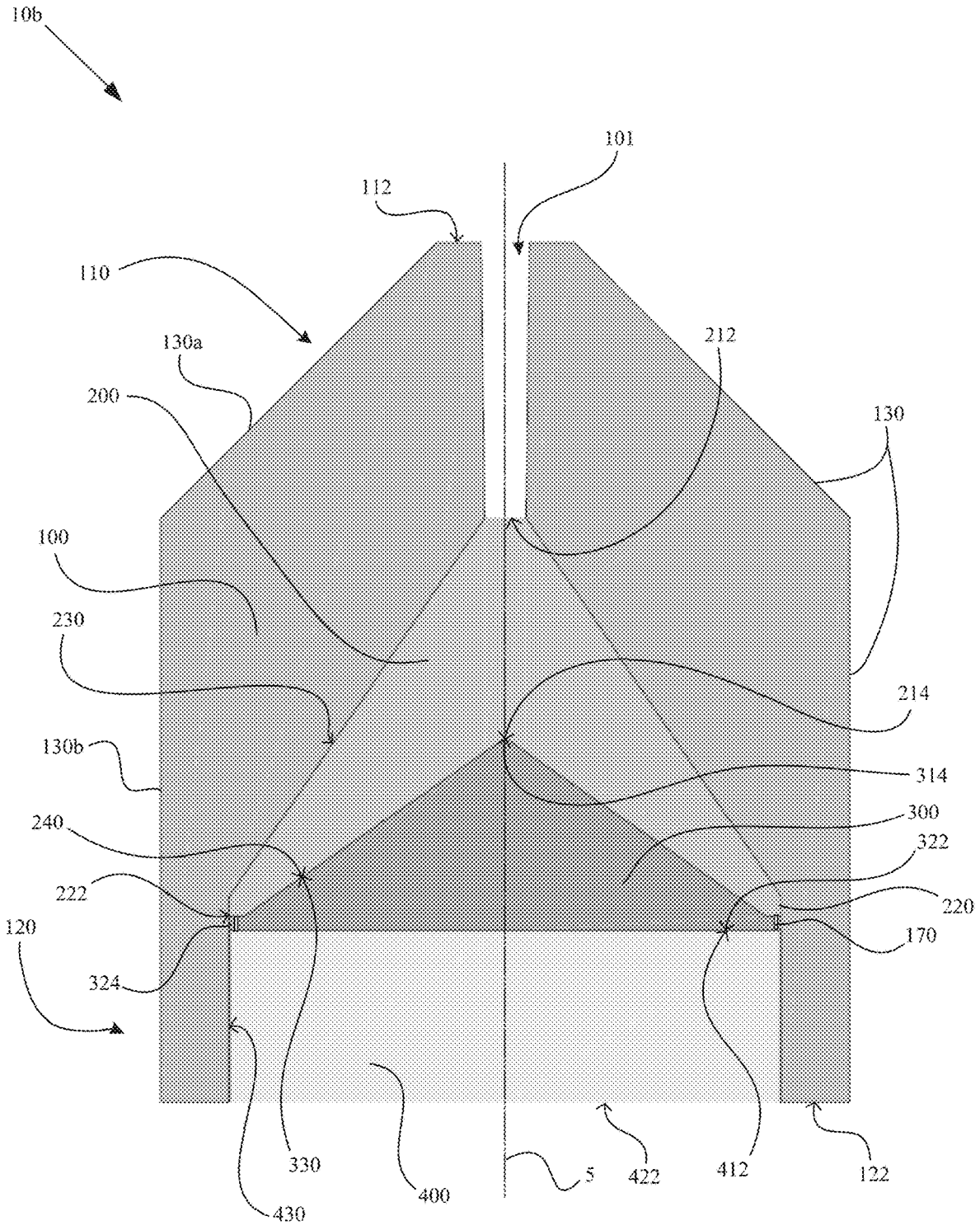
FIG. 2B is a cross-sectional schematic illustration of an explosive device in accordance with another embodiment of the present disclosure, in which the wave shaper includes a set of internal channels that can fluidically couple an upper internal cavity of the body structure and a lower internal cavity of the body structure, wherein the upper internal cavity is configured for carrying or retaining the donor charge, and the lower internal cavity is configured for carrying or retaining the acceptor charge.
Figure 8:
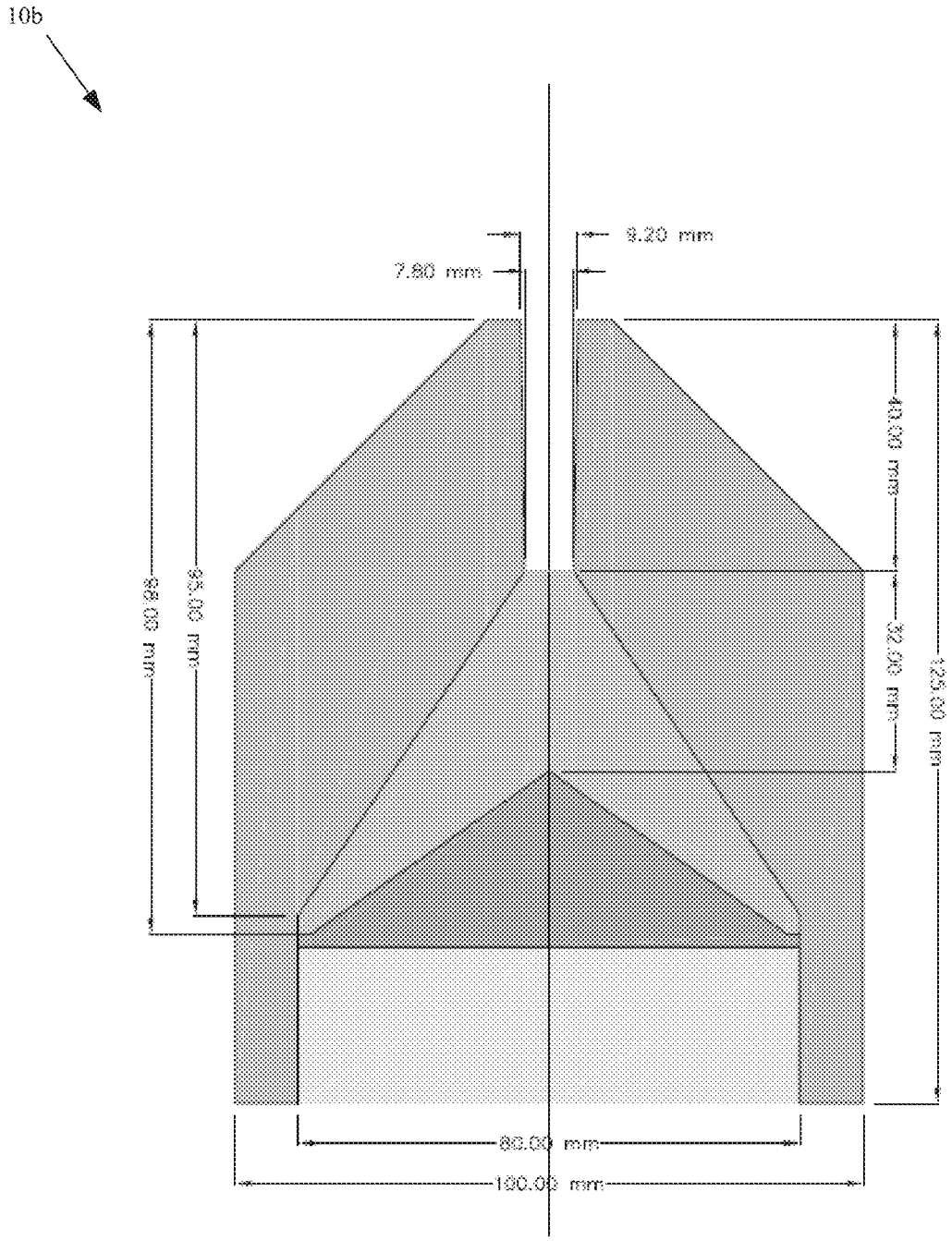
FIG. 8 is a cross-sectional view along a body structure central axis showing dimensions for a non-limiting representative implementation of an explosive device such as that shown in FIG. 2A, or analogously an explosive device such shown in FIGS. 3, 4, and/or 7, and which provides a net explosive mass of 330 g.

FIG. 8 is a cross-sectional view along the central axis 5 showing dimensions for a non-limiting representative implementation of an explosive device 10*b* such as that shown in FIG. 2A, or analogously an explosive device 10*c-d,g* such shown in FIGS. 3, 4, and/or 7, which provides a net explosive mass of 330 g.

As indicated above, explosive devices 10 in accordance with the present disclosure can be manufactured in multiple manners. In an embodiment, a unitary body 100 and the wave shaper 300 are formed as an integral unit from polymer materials, such as polyurethane or nylon 6, 6, e.g., by way of molding, machining, or additive manufacturing. An important or key material property corresponding to the body 100 and the wave shaper 300 for the attainment of a quasi-planar shock wave is the slope of the shock Hugoniot, which reflects the compressibility of the material(s) from which the body 100 and wave shaper 300 are constructed under shock conditions. A properly selected, optimized, or optimal value of this property reduces manufacturing error/aids manufacturability, and appropriately establishes, reduces, optimizes, or minimizes the total amount or net mass of explosive material(s) required for generating a quasi-planar shock wave suitable for a specific application or environment, or particular range of applications or environments, in which the explosive device 10 is deployable or deployed. In various embodiments, the slope of the shock Hugoniot is between 1.5-1.7, e.g., approximately 1.6.

Figure 9A:
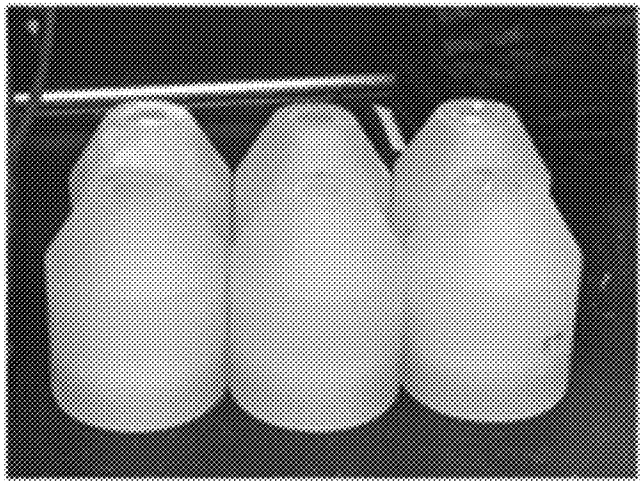
FIG. 9A is an image showing a non-limiting representative implementation of an explosive device body structure having wave shapers therein, and which is configured for carrying net explosive masses of 300 g.
Figure 9A:
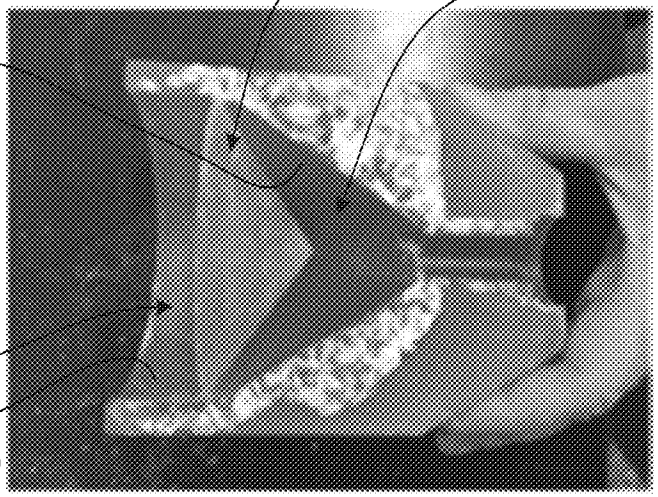
Figure 9B:
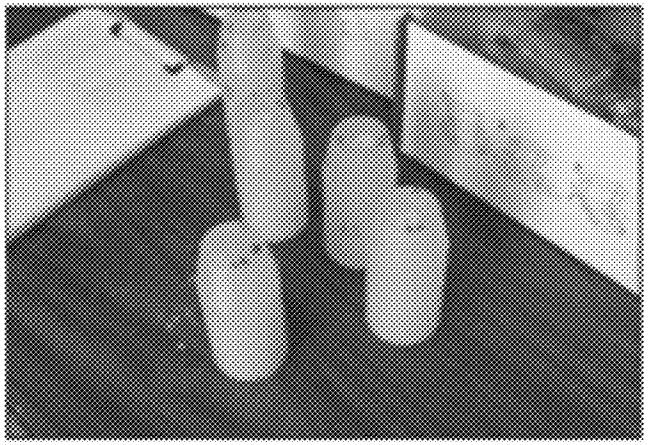
FIG. 9B is an image showing a non-limiting representative implementation of an explosive device body structure having wave shapers therein, and which is configured for carrying net explosive masses of 110 g.
Figure 9B:
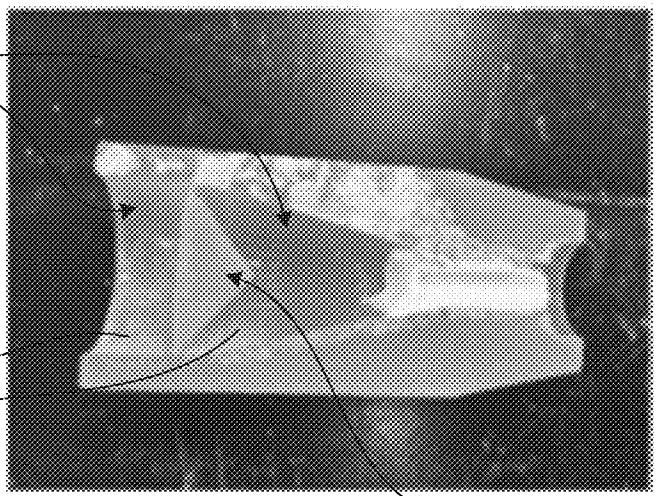

FIGS. 9A-9B show non-limiting representative implementations of explosive device bodies 100 having wave shapers 300 therein, which are configured carrying net explosive masses of 300 g and 110 g. Depending upon embodiment details, an explosive device body 100 and a wave shaper 300 can be formed as an integral unit; or they can be formed separately, and the wave shaper 300 can be introduced, inserted, or affixed into the body 100. In several embodiments, the body 100 includes a set of first or upper internal walls 140*a* that define a first or upper cavity or chamber 160 within the body 100, which establishes the geometric boundaries or borders of the donor charge 200, and which can be referred to as a donor charge chamber 160; and a set of second or lower internal walls 140*b* that define a second or lower cavity or chamber 180 within the body 100, which establishes the geometric boundaries or borders of the acceptor charge 400, and which can be referred to as an acceptor charge chamber 180.

Following the manufacture of a body 100 and a wave shaper 300 as an integral unit or unitary structure, or after the insertion of a separately formed wave shaper 300 into a body 100 that was fabricated separately from or without the wave shaper 300, a melt-castable energetic material or explosive composition, e.g., Pentolite, can be introduced or poured into the body 100 and allowed to solidify to thereby form the donor charge 200 and the acceptor charge 400 within the body's upper chamber 160 and lower chamber 180, respectively. In some embodiments, the manufacture or formation of the donor charge 200 and the acceptor charge 400 within the body 100 occurs separately or sequentially, e.g., by way of different or non-temporally overlapping portions of the overall explosive device manufacturing process. For instance, in one manufacturing process portion, Pentolite can be poured through the body's passage 101 into the upper internal chamber 160 that establishes the geometric borders of the donor charge 200 (e.g., with the body 100 oriented right side up), such that the solidified Pentolite within the upper internal chamber 160 forms the donor charge 200; and in a separate or subsequent manufacturing process portion, Pentolite can be poured directly into the body's lower internal chamber 180 that establishes the geometric borders of the acceptor charge 400 (e.g., with the body 100 inverted or oriented upside down), such that the solidified Pentolite within the lower internal chamber 180 forms the acceptor charge 400.

Figure 9C:
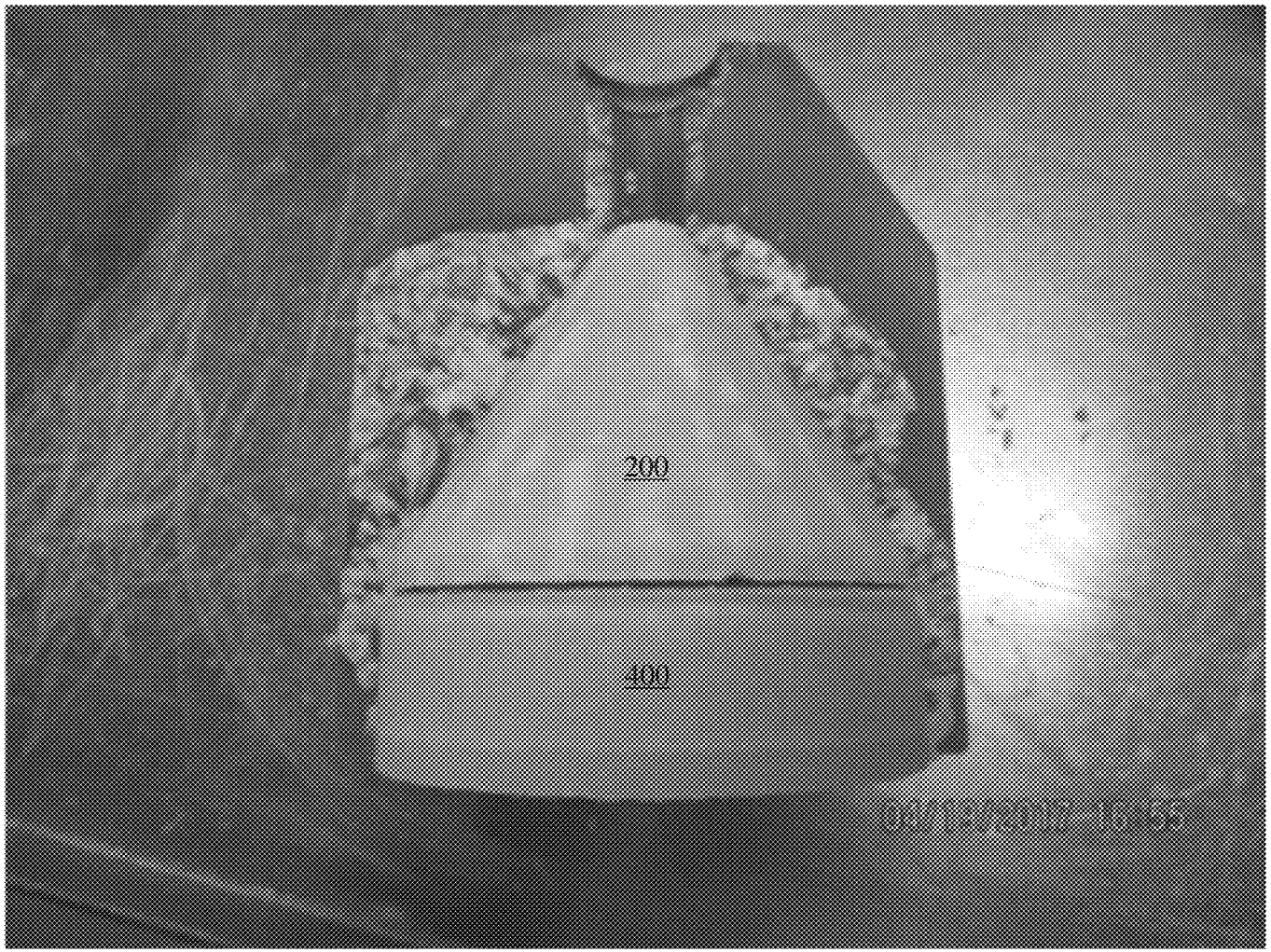
FIG. 9C is an image showing a cutaway view of portions of an explosive device corresponding to FIG. 9A, including the acceptor charge and donor charge thereof, each of which includes or is formed of melt-cast Pentolite in a non-limiting representative limitation, such that the explosive device provides a net explosive mass of 330 g.

FIG. 9C shows a cutaway view of portions of an explosive device 10 corresponding to FIG. 9A, including the acceptor charge 400 and donor charge 200 thereof, each of which includes or is formed of melt-cast Pentolite in a non-limiting representative limitation, such that the explosive device 10 provides a net explosive mass of 330 g.

In some embodiments, e.g., as indicated in FIGS. 2B, 3, 4, 6, and 8, the body 100 includes a set of internal gaps, pathways, conduits, or channels 170 that fluidically couples the upper internal chamber 160 to the lower internal chamber 180, such that a flowable or melt-castable energetic material or explosive composition, e.g., Pentolite, can flow between the upper and lower internal chamber 160, 180 when introduced into one or the other of such chambers 160, 180. In such embodiments, the donor charge 200 and the acceptor charge 400 can be formed by way of a single manufacturing process portion, or temporally overlapping manufacturing process portions, such that the melt-castable energetic material, e.g., Pentolite, is introduced into portions of the upper internal chamber 160 and the lower internal chamber 180 concurrently. For instance, molten Pentolite can be poured into the upper internal chamber 160 by way of the body's initiating device passage 101, and some of the molten Pentolite introduced into the upper internal chamber 160 flows from the upper internal chamber 160 into the lower internal chamber 180 by way of the internal channel(s) 170. After the lower internal chamber 180 has been completely filled the upper internal chamber 160 can be completely filled with molten Pentolite as the introduction or pouring thereof into the upper internal chamber 160 continues or progresses, because Pentolite flow through the internal channel(s) 170 into the lower internal chamber 180 no longer occurs. The upper internal chamber 180 can be filled to a predetermined maximum level, e.g., corresponding to the location within the body 100 at which the upper internal chamber 160 meets the body's passage 101, or a target location along the height of the passage 101. As the molten Pentolite within the explosive device 10 cools, the donor and acceptor charges 200, 400 are formed, in a manner readily understood by individuals having ordinary skill in the relevant art. During such a manufacturing process, the body 100 can be positioned such that its distal end 122 resides upon an essentially planar or planar surface of material to which the melt-cast energetic material does not adhere, or does not significantly adhere, and which has a higher or significantly higher melting point than the melt-cast energetic material. Such a material can include or be, for instance, Teflon. In an alternate technique in which the body 100 is inverted, the molten Pentolite can be poured into the lower internal chamber 180, in which case it can flow into the upper internal chamber 160 by way of the internal channel(s) 170. A plug made of a material such as Teflon can be inserted into the body's passage 101 during such a procedure, and removed or withdrawn after the donor charge 200 and acceptor charges 400 have formed, leaving the passage 101 free of the energetic material.

Depending upon embodiment details, the body 100 and the wave shaper 300 can be fabricated as separate elements, parts, or pieces, and the wave shaper 300 can be inserted, clipped, or snap-fit into the body 100 by way of counterpart engagement/retention structures, elements, or members, such as clip structures formed in the donor charge 200 and the wave shaper 300 themselves, e.g., at particular locations at or around the periphery of the donor charge's lowest end 222 and the periphery of the wave shaper's terminal surface 322, e.g., such as on a lower lip structure 324 of the wave shaper 300, which enable secure retention of the wave shaper 300 against the donor charge 200. The aforementioned set of internal channels 170 can be formed to include apertures or openings in this lower lip structure 324, and/or in one or more portions of the body 100.

In other embodiments, one or each of the acceptor charge 400 and the donor charge 200 can be formed of a pressable or pressed energetic material or explosive composition, such as an RDX—wax blend. For instance, an RDX—wax blend can be pressed directly into the body's upper interior chamber 160 and/or the lower interior chamber 180 to respectively form the acceptor charge 400 and/or the donor charge 200 by way of a pressing apparatus, in a manner readily understood by individuals having ordinary skill in the art. Alternatively, one or more energetic compounds can be pressed and then inserted into one or more preformed chambers of the explosive device 10 to form the donor charge 200 and/or the acceptor charge 400, as further detailed below.

With respect to various embodiments of an explosive device 10*c-d* that can be assembled by engaging a top piece 102 with any one of multiple lower pieces 104, or coupling the top piece 102 to a stack of lower pieces 104, the top piece 102 can include or provide a first or upper internal chamber 160 into which an energetic material or explosive composition can be introduced, and the lower piece 104 can include or provide a second or lower internal chamber 180 into which the same or a different energetic material or explosive composition can be introduced, in a manner analogous to that set forth above. For instance, a flowable or melt-castable energetic material can be introduced into the upper chamber 160, e.g., in a manner indicated above, to form the top piece 100 and its internally carried acceptor charge 200. Depending upon embodiment details, a flowable or melt-castable energetic material can be introduced into one or more lower internal chambers 180; and/or one or more pressable energetic materials can be pre-pressed into intended donor charge shapes (e.g., within a ring of material such as Teflon), and then assembled (e.g., glued) into one or more corresponding lower internal chambers 180 to form lower pieces 104 and the donor charges 400 retained thereby.

In still further embodiments in accordance with the present disclosure, one or each of the acceptor charge 400 and the donor charge 200 can be produced by way of additive manufacturing. Hence, depending upon embodiment details, one or more of the body 110 (whether the body 110 is produced as a unitary structure or a multi-part structure, e.g., having a top piece 102 that is couplable to a set of lower pieces 104), the donor charge 200, the wave shaper 300, and the acceptor charge 400 can be produced by way of additive manufacturing.

Particular non-limiting representative implementations of explosive devices 10 manufactured in accordance with an embodiment of the present disclosure were tested in a representative in-field seismic spread trial. The tested explosive devices 10 were analogous or corresponded to the embodiment shown in FIG. 2B, and carried a doubly-truncated (e.g., horizontally and vertically truncated) type of cylindrical donor charge 200 such as described above. More particularly, for the seismic spread trial, explosive devices 110 having net explosive masses of 330 g and 110 g were fabricated. The seismic spread trial was conducted by deploying or positioning the fabricated explosive devices 10 such that their distal ends 112 resided directly against the surface of the earth, that is, this trial was conducted without the explosive devices 10 residing in boreholes. Prior to the in-field initiation of the test explosive devices 10, ambient or background seismic noise at the field test site was measured using Sercel SG-5 geophones, which were also used to measure reflected seismic signals corresponding to the quasi-planar shock waves output by the tested explosive devices 10 after their in-field initiation.

Figure 10:
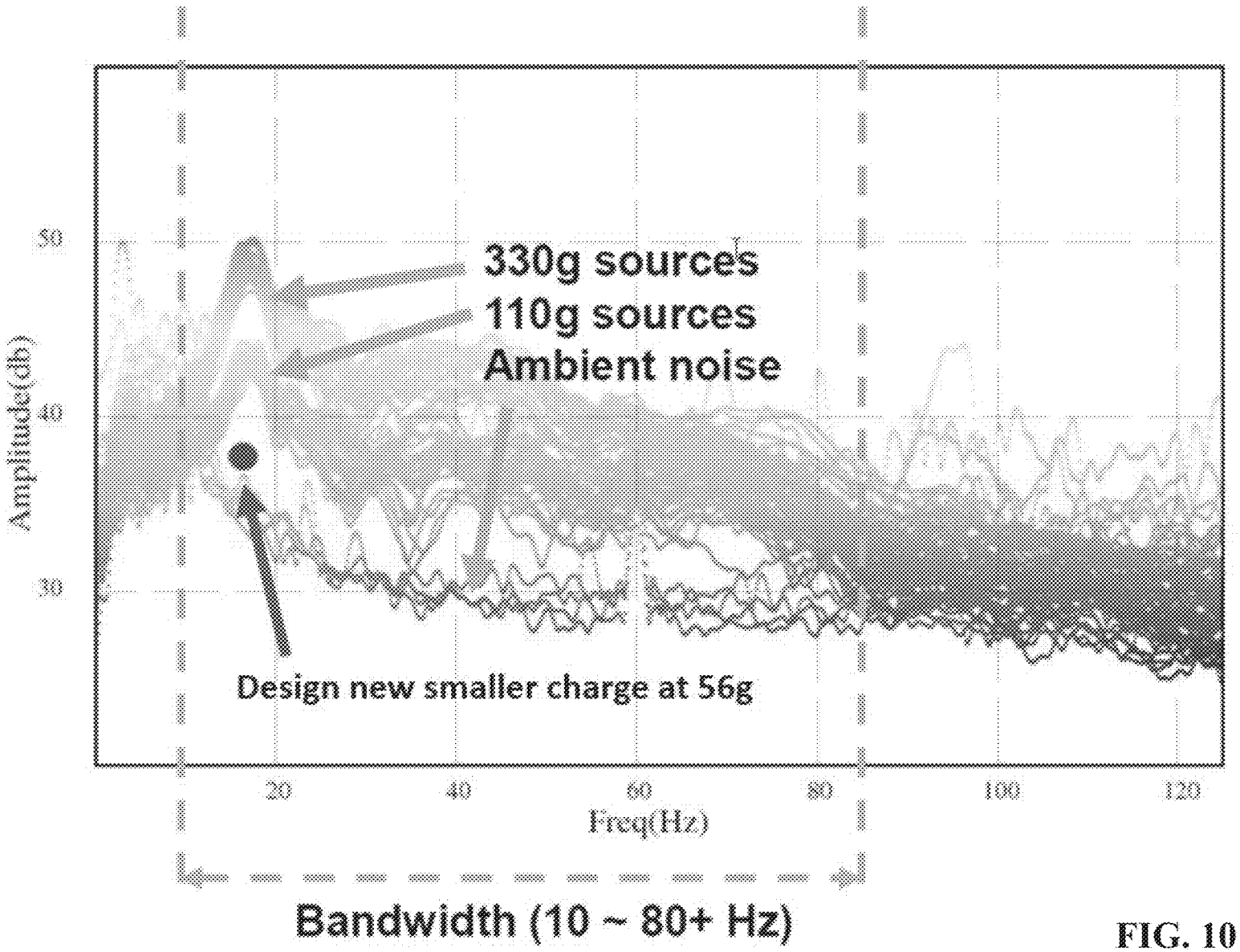
FIG. 10 is a plot showing reflected seismic signals measured during an in-field seismic spread trial employing explosive devices in accordance with particular embodiments of the present disclosure, as well as ambient seismic noise signals measured during the in-field seismic spread trial.

FIG. 10 is a plot showing reflected seismic signals measured during the in-field seismic spread trial, as well as ambient seismic noise signals measured prior to the in-field seismic spread trial. As indicated in FIG. 10, within a useful or practical seismic signal bandwidth between approximately 10-85 Hz, the reflected seismic signals corresponding to the tested 330 g and 110 g explosive devices 10 demonstrated a good to very good signal-to-noise (S/N) ratio. Hence, explosive devices 10 in accordance with embodiments of the present disclosure can be used or deployed in seismic exploration applications (e.g., land-based seismic exploration) by disposing the distal ends 112 of such devices 10 directly on or against the surface of the earth (or disposing one or more of explosive devices 10 that include an attenuation cap 500 such that the attenuation cap 500 resides directly against the surface of the earth), in the absence or outside of boreholes. Furthermore, in view the results shown in FIG. 10, explosive devices 10 in accordance with embodiments of the present disclosure can additionally or alternatively be deployed or used in seismic exploration applications by positioning such devices in shallow or very shallow holes or boreholes formed in the earth, e.g, holes or boreholes having a depth of 0.05-2.5 meters, which is much shallower than the depth of boreholes drilled into the earth as part of conventional seismic exploration applications.

Based on the measured data corresponding to FIG. 10, a net explosive charge mass of 56 g was calculated by a linear curve fit in amplitude—frequency space to be a smaller or minimum practical or useful net explosive charge mass relative to the ambient seismic noise at the field trial site or similar sites, i.e., a net explosive mass that would generate a seismic signal that upon reflection from underlying substrata up to a depth of approximately 20-150 meters (e.g., approximately 30-100 meters, or approximately 40-80 meters) or more (e.g., up to approximately 200, 250, 300, 350, 400, 450, or 500 meters) would be reliably discernable above the ambient seismic noise level across the aforementioned seismic signal bandwidth.

Figure 11:
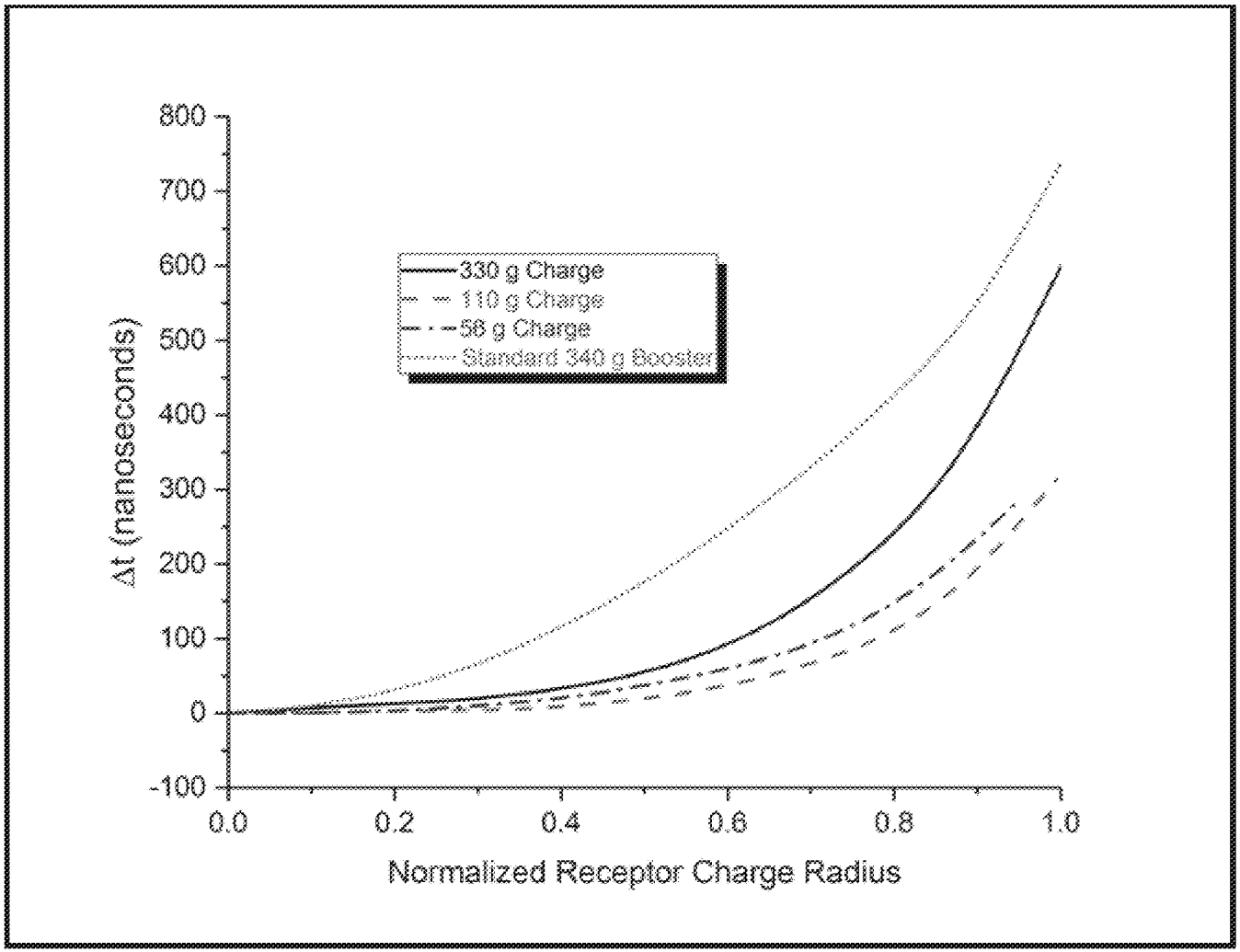
FIG. 11 is a graph showing numerical simulation or modelling results corresponding to the curvature of (a) shock wave fronts output from the distal end of explosive devices in accordance with particular embodiments of the present disclosure such as those tested in the seismic spread trial for three non-limiting representative net explosive masses, namely, 330 g, 110 g, and 56 g; and (b) the shock wave front output at an analogous or corresponding distal end of a standard or conventional (e.g., commercially available, centrally initiated) cylindrical explosive booster (hereafter "standard booster") having an explosive mass of 340 g, with respect to normalized radial distance away from a central axis of each explosive device and an analogous or corresponding axis of symmetry of the standard booster.

FIG. 11 is a graph showing numerical simulation or modelling results corresponding to the curvature of (a) shock wave fronts output from the distal end 122 of explosive devices 10 in accordance with embodiments of the present disclosure such as those tested in the seismic spread trial for three non-limiting representative net explosive masses, namely, 330 g, 110 g, and 56 g; and (b) the shock wave front output at an analogous or corresponding distal end of a standard or conventional (e.g., commercially available, centrally initiated) cylindrical explosive booster (hereafter "standard booster") having an explosive mass of 340 g, with respect to normalized radial distance away from the central axis 5 of the explosive devices 10 and an analogous or corresponding axis of symmetry of the standard booster.

It is readily apparent from the numerical simulation results that the shock fronts output at the distal ends 122 of the explosive devices 10 in accordance with embodiments of the present disclosure are significantly less hemispherical, and significantly more planar, than the shock front output at a corresponding end of a standard cylindrical booster. Among the three explosive devices 10 having net explosive masses of 330 g, 110 g, and 56 g, the shock front output at the distal end 122 of the 110 g device showed the lowest relative curvature, and hence the highest relative planarity, across the radial extent of the explosive device 10, which was nearly matched by the shock front output by the 56 g device. The 330 g device output a shock front having a relative curvature, and hence a relative planarity, between that of the 56 g device and the standard booster. It can further be seen that at least up to a normalized radial distance of 0.4-0.6 (e.g., approximately 0.5) away from the central axis 5, the shock fronts output by the 110 g and 56 g devices exhibited dramatically less curvature, and hence dramatically greater planarity, than the shock front output by the standard booster.

For each shock front curve shown in FIG. 11, a closest-fit parabola corresponding to the underlying shock front curve simulation data was determined; and the focus of each such parabola along the z-axis (i.e., along the central axis 5 of each explosive device 10 under consideration, or along the axis of symmetry of the standard booster) referenced to the corresponding device distal end was calculated, in a manner readily understood by individuals having ordinary skill in the relevant art. The parabola focus value calculated for the standard booster can define a reference or benchmark parabola focus value. Therefore, the value of the parabola focus corresponding to each explosive device 10 under consideration relative to the reference parabola focus value can provide a quantitative measure that indicates or is correlated with the extent to which the corresponding shock wave is less hemispherical than the shock wave output by the standard booster, and is more planar than hemispherical, and thus can provide a numerical indicator or measure of shock wave quasi-planarity. Table 1 below shows the calculated distances of parabola foci corresponding to each shock front curve of FIG. 11, as well as corresponding $R^2$ values that indicate how well the parabolas fit the underlying data for the shock fronts, as individuals having ordinary skill in the relevant art will readily understand.

TABLE 1

Calculated focus for a parabola fit to each shock front curve of FIG. 11

| Explosive Charge Geometry | Net Explosive Mass (g) | Parabola Focus | $R^2$ |
|---|---|---|---|
| Conical-type Donor Charge | 56 | 9.65E−04 | 0.83 |
| Conical-type Donor Charge | 110 | 1.09E−03 | 0.88 |
| Conical-type Donor Charge | 330 | 5.33E−04 | 0.91 |
| Standard Cylindrical Booster | 340 | 3.59E−04 | 0.99 |

As indicated by Table 1, the shock wave output by the standard cylindrical booster had a reference parabola focus value of 3.59E-04. This reference parabola focus value was the smallest parabola focus value for the shock wave data sets consideration. Also, the standard cylindrical booster output the most parabolic, or the least planar, shock wave, as indicated by its $R^2$ value.

The shock wave output by the explosive device 10 having a net explosive mass of 110 g had a parabola focus value of 1.09E-03, which defines an upward or vertical parabola focus shift along the z-axis of approximately 203.6% with respect to the reference parabola focus. Consequently, at the distal end 122 of the 110 g device, the shock wave exhibited much greater planarity than the shock wave output at the analogous end of the standard booster. Furthermore, the shock wave output by the 110 g device was the least parabolic of the shock waves under consideration.

The shock wave output by the explosive device 10 having a net explosive mass of 56 g had a parabola focus value of 9.65E-04, which defines an upward or vertical parabola focus shift along the z-axis of approximately 168.8% with respect to the reference parabola focus. Hence, at the distal end 122 of the 56 g device, the shock wave also exhibited much greater planarity than the shock wave output at the analogous end of the standard booster. The shock wave output by the 56 g device was the second-least parabolic of the shock waves output by the explosive devices 10 under consideration.

Finally, the shock wave output by the explosive device 10 having a net explosive mass of 330 g had a parabola focus value of 5.33E-04, which defines an upward or vertical parabola focus shift along the z-axis of approximately 48.5% with respect to the reference parabola focus. Hence, at the distal end 122 of the 56 g device, the shock wave was significantly more planar than the shock wave output at the analogous end of the standard booster. As indicated by its R 2 value, the shock wave output by the 330 g device was the next-least parabolic of the shock waves output by the explosive devices 10 under consideration.

Because the lower surface 422 of the acceptor charge 400 outputs a quasi-planar shock wave, i.e., a shock wave that is significantly or dramatically less parabolic or hemispherical than that output by a standard cylindrical booster, the distal end 122 of an explosive device 10 in accordance with embodiments of the present disclosure can preferentially couple or deliver explosive energy into an adjacent target material, substrate, or environment much more effectively than the analogous or similar end of the standard booster.

Further to the information provided in FIG. 11 and Table 1, Table 2 below provides numerical modelling or simulation data showing the percentage of explosive energy output across the entirety of (a) the lower surface 422 of the acceptor charge 400, relative to overall stored chemical energy for the 56 g, 110 g, and 330 g explosive devices 10; and (b) the analogous or corresponding distal end of the 340 g standard cylindrical booster.

TABLE 2

Percentage of explosive energy output across distal end relative to overall stored chemical energy

| Explosive Charge Geometry | Net Explosive Mass of Device (g) | Explosive Energy Output at Principal Output End (% Stored Chemical Energy) |
|---|---|---|
| Conical-type Donor Charge | 56 | 24.4 |
| Conical-type Donor Charge | 110 | 27.5 |
| Conical-type Donor Charge | 330 | 10.1 |
| Standard Cylindrical Booster | 340 | 2.4 |

As indicated in Table 2, the 110 g, 56 g, and 330 g explosive devices 10 respectively released 27.5%, 24.4%, and 10.1% of their stored explosive energies across their acceptor charge lower surfaces 422, whereas the 340 g standard booster released only 2.4% of its explosive energy across its corresponding distal end, which represents an increase in distal end energy release of 1045.8%, 916.6%, and 320.8% for the 110 g, 56 g, and 330 g explosive devices 10 relative to the 340 g standard booster. Hence, explosive devices 10 in accordance with embodiments of the present disclosure exhibit significantly, greatly, or dramatically increased distal end explosive energy release compared to standard cylindrical boosters (e.g., at least by a factor of 2).

The seismic energy imparted into a target material, substrate, or substance disposed at the distal end 122 of an explosive device 10 in accordance with an embodiment of the present disclosure depends not only on net explosive charge mass, but also upon donor charge geometry. That is, the relative efficiency that an explosive device 10 exhibits in converting its stored explosive energy into a quasi-planar shock wave output at the device's distal end 112 also depends upon donor charge geometry.

Figure 12:
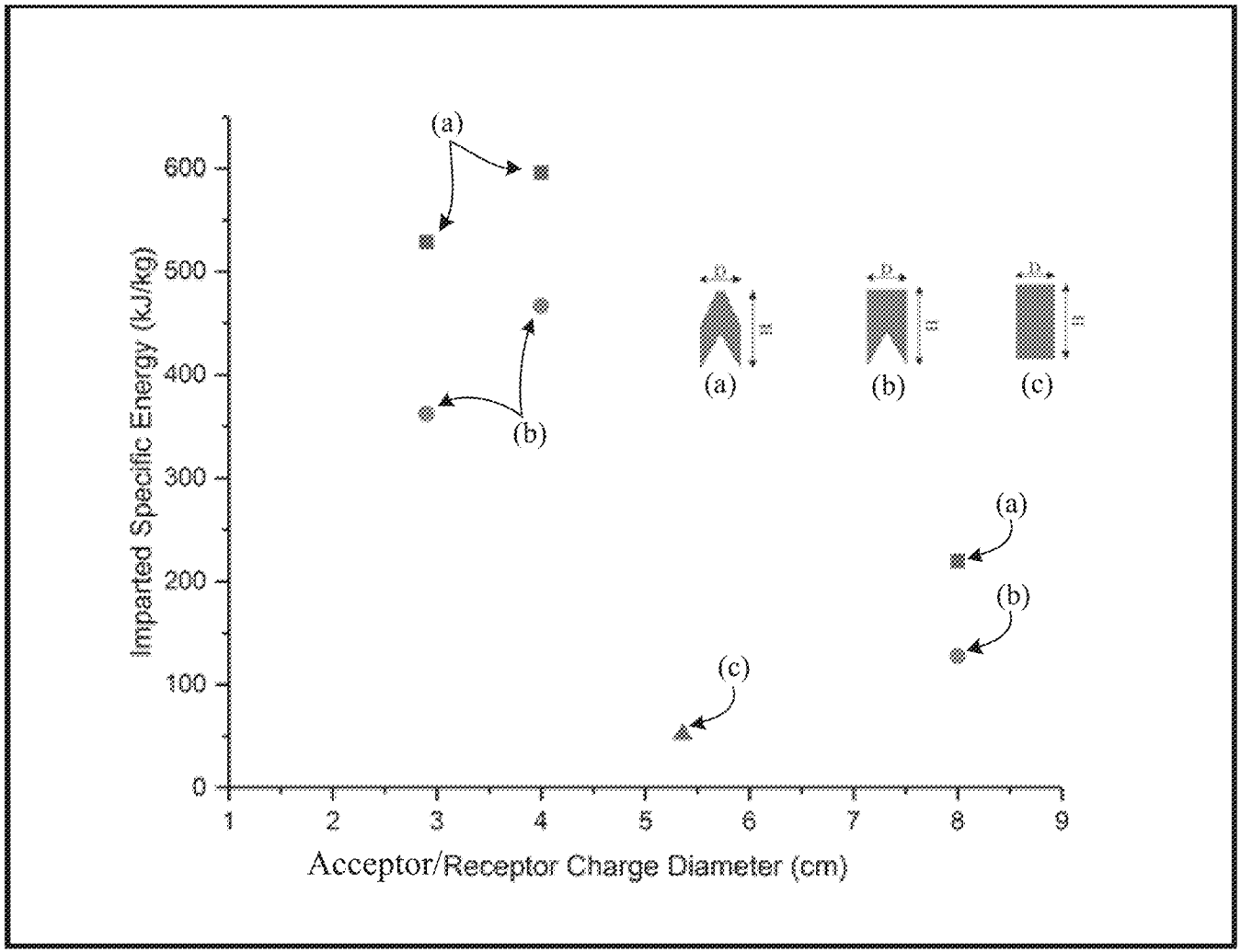
FIG. 12 is a plot showing numerical simulation or modelling results for specific seismic energy imparted versus donor charge diameter (D) by (a) an explosive device a having quasi-conical donor charge, a wave shaper, and an acceptor charge in accordance with an embodiment of the present disclosure, and a net explosive charge mass of 330 g; (b) an explosive device having a cylindrical rather than quasi-conical donor charge, plus a wave shaper and an acceptor charge in accordance with an embodiment of the present disclosure, and a net explosive charge mass of 330 g; and (c) a 340 g standard booster, where each of such devices has an identical height (H).

FIG. 12 is a plot showing numerical simulation or modelling results for specific seismic energy imparted versus donor charge diameter (D) by (a) an explosive device 10 a having quasi-conical donor charge 200, a wave shaper 300, and an acceptor charge 400 as set forth above, and a net explosive charge mass of 330 g; (b) an explosive device 10 having a cylindrical rather than quasi-conical donor charge 200, plus a wave shaper 300 and an acceptor charge 400 as set forth above, and a net explosive charge mass of 330 g; and (c) a 340 g standard booster, where each of such device have an identical height (H), e.g., corresponding to the height value shown in FIG. 8. As indicated in FIG. 12, the specific seismic energy imparted by an explosive device 10 having a quasi-conical donor charge 200 is significantly greater than that of an explosive device 10 having a cylindrical donor charge 200, both of which are dramatically or significantly greater than that of a standard booster.

Table 3 below provides non-limiting representative approximate structural dimension values or value ranges for certain embodiments of explosive devices 10, e.g., explosive devices having net explosive masses between approximately 56 g-330 g, in accordance with the present disclosure.

TABLE 3

Representative approximate structural dimension parameter values or value ranges for explosive devices, e.g., having net explosive masses between approximately 56 g-330 g.

| Dimension | Approx. Value(s) |
|---|---|
| Donor Charge Peak Angle off Axis of Symmetry (deg) | 8-32 |
| Minimum Acceptor Charge Thickness (mm) | 24 |
| Minimum Net Explosive Mass (g) | 50-55 |
| Minimum Total Device height (mm) | 125 |
| Distance from Well to Wave Shaper Apex (mm) | 25-42 |
| Minimum Acceptor Charge Diameter (mm) | 29 |
| Wave Shaper Apex Angle (degrees) | 37.5-43.3 |
| Thickness of Wave Shaper Retaining Clip (mm) | 2.7-2.9 |

The above description details aspects of explosive devices 10 configured for outputting quasi-planar shock waves at their distal ends 112 in accordance with particular non-limiting representative embodiments of the present disclosure. It will be readily understood by a person having ordinary skill in the relevant art that various modifications can be made to one or more aspects or portions of these and related embodiments without departing from the scope of the present disclosure. As a non-limiting representative example, a multi-piece explosive device 10 can have a first piece 102 that carries the donor charge 200, and a second piece 104 that carries both the wave shaper 300 and the acceptor charge 400, e.g., where such pieces 102, 104 can be coupled to or engaged with each other in a manner set forth above.

The invention claimed is:

1. An explosive device comprising:

a body structure having a proximal end, an opposing distal end, a set of outer walls between the proximal end and the distal end, a height along the set of outer walls, and a central axis extending along the height, wherein the central axis extends through a center point of the proximal end and a center point of the distal end;

a slot or chamber formed within the body structure and configured for carrying a portion of an explosive initiation device;

a donor explosive charge mass residing within the body structure and having an upper end disposed proximate or adjacent to or in contact with a portion of the slot or chamber of the body structure, the donor explosive charge mass extending downwardly toward the distal end of the body structure, wherein portions of the donor explosive charge mass exhibit a geometric shape that is correlated with or which corresponds to a first cone having a void formed therein, wherein the void exhibits a geometric shape that is correlated with or which corresponds to a second cone, and wherein a first base of the first cone and a second base of the second cone share a common center point through which the central axis of the body structure extends, the first cone is vertically truncated about the central axis of the body structure at a predetermined radial distance away from the central axis;

a non-explosive wave shaper residing within the body structure and occupying the void; and an acceptor explosive charge mass that downwardly extends away from the wave shaper toward the distal end of the body structure, the acceptor explosive charge mass including an upper surface disposable or disposed adjacent to a terminal surface of the non-explosive wave shaper; and a lower surface disposed at a predetermined distance below the upper surface such that a first quasi-planar shock wave output at the terminal surface of the non-explosive wave shaper serves as a shock initiation source for initiating the acceptor explosive charge mass, and wherein the acceptor explosive charge mass is configured for explosively amplifying the first quasi-planar shock wave while retaining or approximately maintaining wave front quasi-planarity to generate a second quasi-planar shock wave that is output at the lower surface of the acceptor explosive charge mass.

2. The explosive device of claim 1, wherein the donor explosive charge mass, the wave shaper, and the acceptor explosive charge mass are cooperatively aligned relative to each other such that a maximum lateral span of the wave shaper perpendicular to the central axis of the body structure coincides with each of a maximum lateral span of the donor explosive charge mass perpendicular to the central axis and a maximum lateral span of the acceptor explosive charge mass perpendicular to the central axis, and wherein the acceptor explosive charge mass does not laterally extend to the set of outer walls of the body structure, and wherein the wave shaper is disposed directly adjacent to the donor explosive charge mass, and wherein the acceptor explosive charge mass is disposed directly adjacent to the wave shaper.

3. The explosive device of claim 1, wherein the donor explosive charge mass exhibits a geometric shape that is correlated with or which corresponds to a right circular frustum of material, such that the upper end of the donor explosive charge mass corresponds to an upper base of the frustum of material, and a lowest end of the donor explosive charge mass corresponds to a lower base of the frustum of material.

4. The explosive device of claim 1, wherein the acceptor explosive charge mass exhibits a geometric shape that is correlated with or which corresponds to a cylinder.

5. The explosive device of claim 1, wherein the body structure exhibits a tapered geometric shape providing an upper tapered region across which the body structure narrows in a direction toward its proximal end.

6. The explosive device of claim 1, wherein the donor explosive charge mass resides within an upper internal cavity formed within the body structure, the acceptor explosive charge mass resides within a lower internal cavity formed within the body structure, the upper internal cavity and the lower internal cavity are separated from each other by the wave shaper, and the wave shaper includes a set of channels formed therein that fluidically couples the upper internal chamber to the lower internal chamber.

7. The explosive device of claim 1, wherein the body structure is a unitary structure.

8. The explosive device of claim 1, wherein the body structure comprises (i) an upper piece that carries the donor explosive charge mass and the wave shaper, and (ii) at least a first lower piece that is selectively couplable to the upper piece, and which carries the acceptor explosive charge mass.

9. The explosive device of claim 8, wherein the first lower piece and the upper piece each carry counterpart snap-fit engagement structures or screw-type engagement structures by which they are couplable together.

10. The explosive device of claim 8, wherein the first lower piece is selectively couplable to a second lower piece that carries an additional acceptor charge.

11. The explosive device of claim 10, wherein the first lower piece and the second lower piece each carry counterpart snap-fit engagement structures or screw-type engagement structures by which the first lower piece and the second lower piece are couplable together.

12. The explosive device of claim 10, wherein the acceptor charge and the additional acceptor charge are different with respect to acceptor charge thickness, net explosive mass, explosive composition, and/or energy release properties.

13. The explosive device of claim 1, wherein the wave shaper exhibits a vertical cross sectional area parallel to the central axis that geometrically corresponds to or is correlated with a triangle having an apex, and wherein an apex angle of the triangle is between 37.5-43.3 degrees.

14. The explosive device of claim 1, wherein a net explosive mass provided by the explosive device is between 50-330 g.

15. The explosive device of claim 1, wherein the non-explosive wave shaper is disposed by the same predetermined radial distance away from the central axis as the first cone, and wherein the acceptor explosive charge mass is disposed by the same predetermined radial distance away from the central axis as the non-explosive wave shaper and the first cone, such that a maximum lateral or horizontal spatial extent or span of the non-explosive wave shaper away from the central axis coincides with, limits, approximately establishes, or establishes the maximum lateral or horizontal spatial extent or span of the donor explosive charge mass and the acceptor explosive charge mass away from the central axis.

* * * * *